US008813674B2

(12) United States Patent
Tait

(10) Patent No.: US 8,813,674 B2
(45) Date of Patent: Aug. 26, 2014

(54) FLAG PROTECTION DEVICE

(75) Inventor: Cyril Stephen Tait, Ferntree Gully (AU)

(73) Assignee: Stowaway Flag Poles Pty Ltd, Victoria (AU)

( * ) Notice: Subject to any disclaimer, the term of this patent is extended or adjusted under 35 U.S.C. 154(b) by 376 days.

(21) Appl. No.: 13/392,465

(22) PCT Filed: Aug. 27, 2010

(86) PCT No.: PCT/AU2010/001112

§ 371 (c)(1),
(2), (4) Date: Mar. 21, 2012

(87) PCT Pub. No.: WO2011/022784

PCT Pub. Date: Mar. 3, 2011

(65) Prior Publication Data

US 2012/0167815 A1 Jul. 5, 2012

(30) Foreign Application Priority Data

Aug. 28, 2009 (AU) ..... 2009904147

(51) Int. Cl.
*G09F 17/00* (2006.01)

(52) U.S. Cl.
CPC ..... *G09F 17/00* (2013.01); *G09F 2017/0066* (2013.01); *G09F 2017/0025* (2013.01); *G09F 2017/005* (2013.01)
USPC ..... 116/173

(58) Field of Classification Search
CPC . G09F 17/00; G09F 17/0091; G09F 2017/00; G09F 2017/005; E04H 12/32
USPC ..... 116/173, 174, 175; 40/218, 606.09, 40/606.14, 606.15, 611.09; 52/146; 160/10
See application file for complete search history.

(56) References Cited

U.S. PATENT DOCUMENTS

| | | | | | |
|---|---|---|---|---|---|
| 877,967 | A * | 2/1908 | Taylor | 116/175 |
| 950,867 | A * | 3/1910 | Ruggles | 116/175 |
| 960,669 | A * | 6/1910 | Morgan | 116/173 |
| 1,321,837 | A * | 11/1919 | Mader | 116/173 |
| 2,630,779 | A * | 3/1953 | Mader | 116/173 |
| 3,417,732 | A | 12/1968 | Platt | |
| 3,675,615 | A * | 7/1972 | Stangarone et al. | 116/173 |
| 3,675,616 | A * | 7/1972 | McInnis | 116/173 |
| 3,923,001 | A * | 12/1975 | Murdock | 116/173 |
| 4,972,794 | A | 11/1990 | Smyly | |
| 5,983,825 | A | 11/1999 | Nowak | |
| 8,539,902 | B2 * | 9/2013 | Sanvik | 116/173 |

FOREIGN PATENT DOCUMENTS

| | | | | |
|---|---|---|---|---|
| KR | 863711 B1 * | 10/2008 | | G09F 17/00 |
| KR | 2011105462 A * | 9/2011 | | G09F 17/00 |
| WO | WO 9709500 A1 * | 3/1997 | | E04H 12/32 |

* cited by examiner

*Primary Examiner* — R. A. Smith
(74) *Attorney, Agent, or Firm* — Andrew Wilford

(57) ABSTRACT

This invention is related to a device for protecting a flag located in a storage space, the storage space having an aperture disposed forwardly of the storage space, such that when the aperture is uncovered, the flag is able to be displayed, the device includes a retractable shutter for substantially covering the aperture, the retractable shutter includes a shutter actuator for deploying and retracting the shutter.

19 Claims, 20 Drawing Sheets

FIG. 23
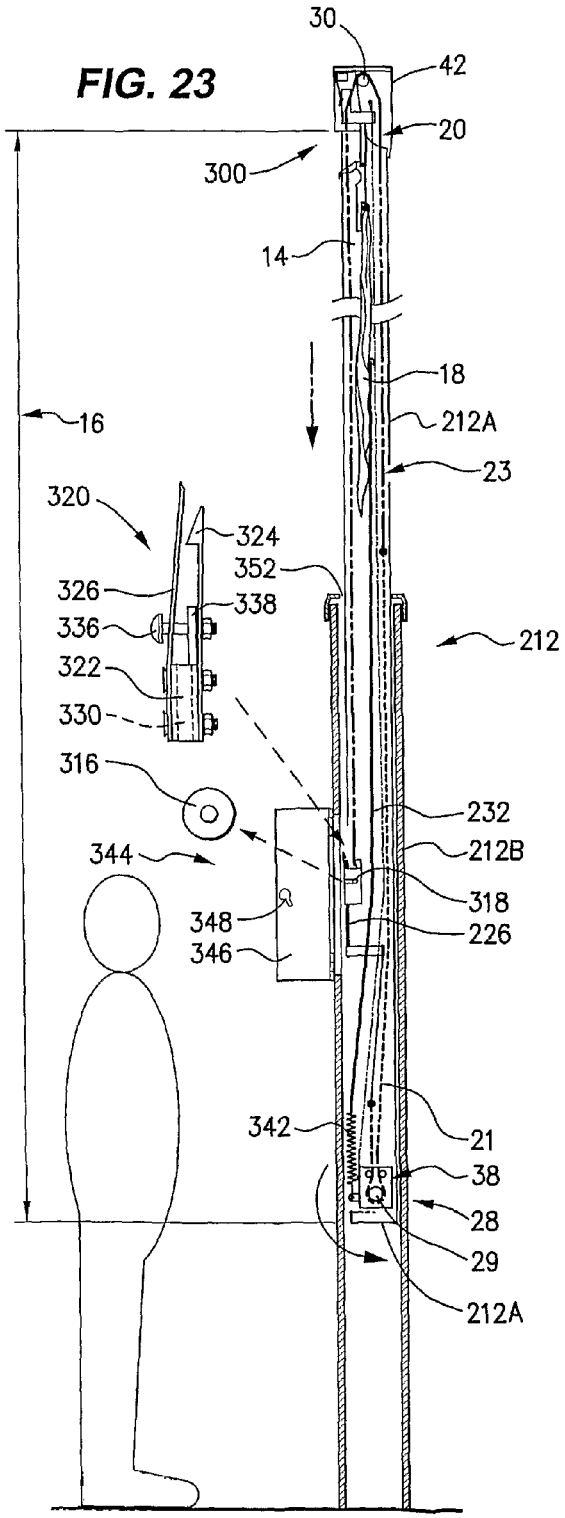
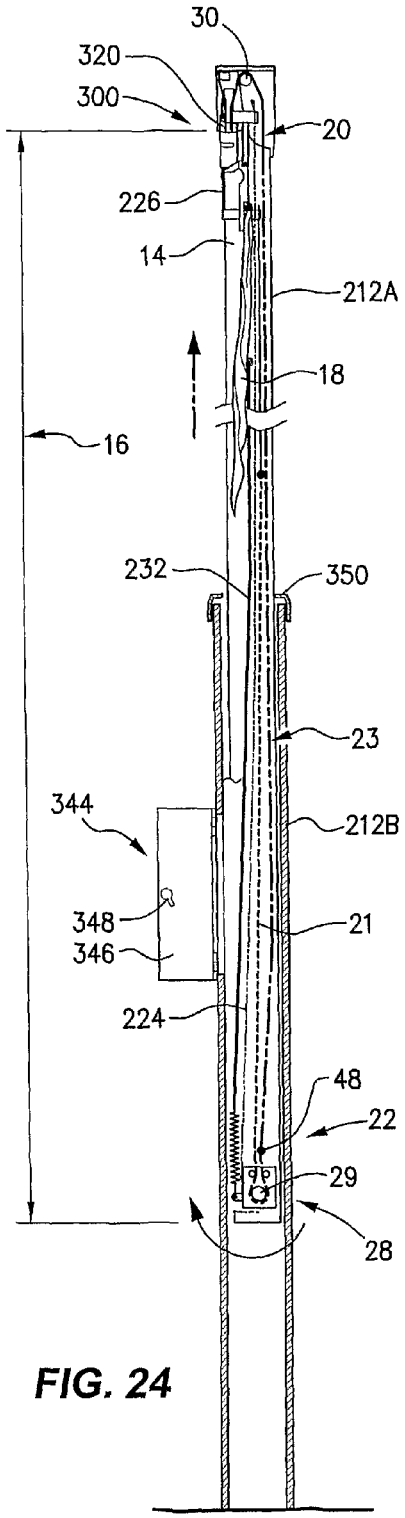
FIG. 24

FIG. 28
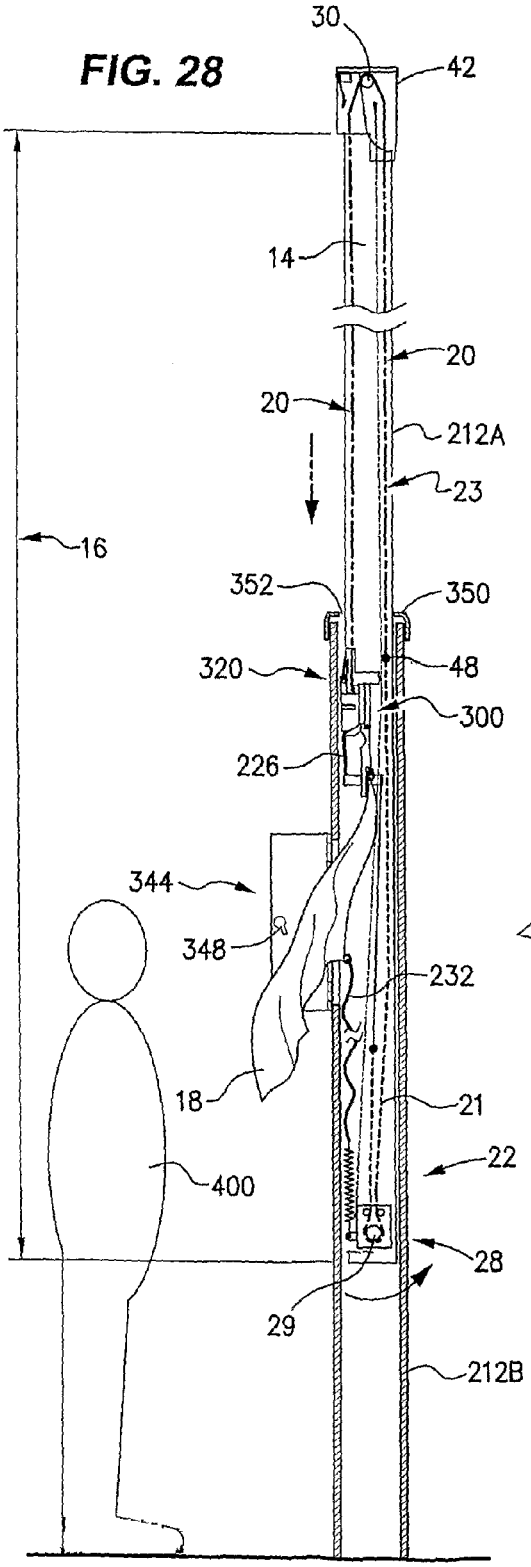
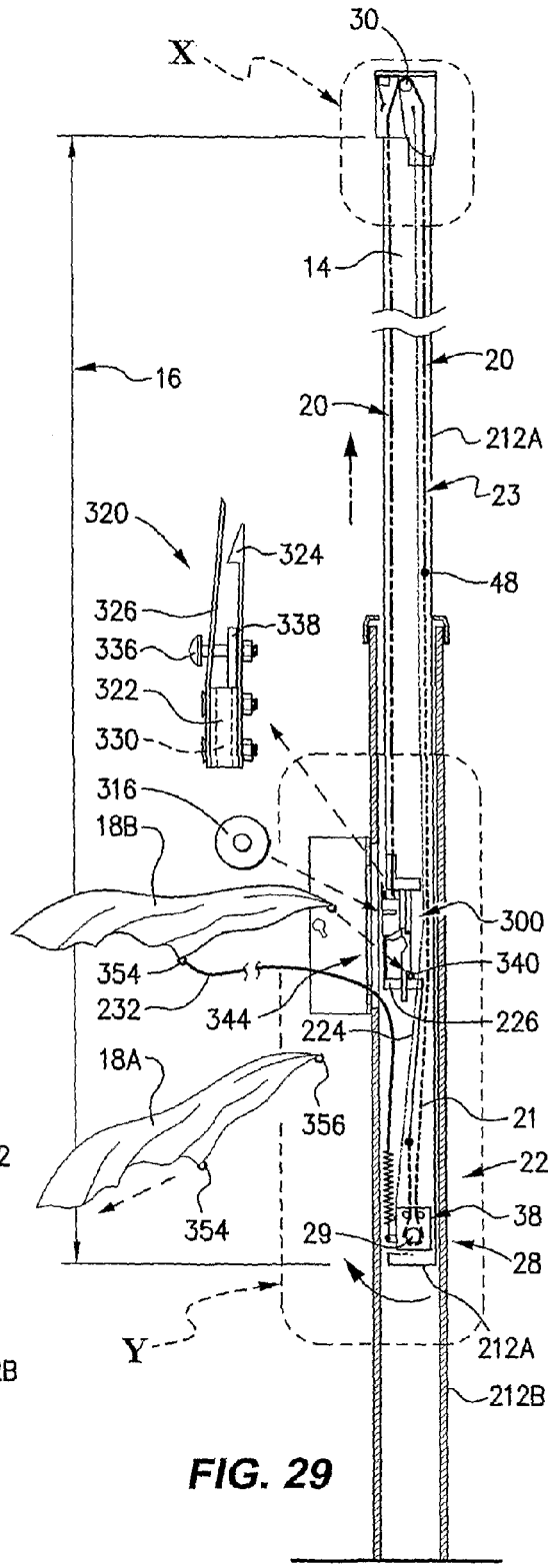
FIG. 29

FLAG PROTECTION DEVICE

CROSS REFERENCE TO RELATED APPLICATIONS

This application is the US-national stage of PCT application PCT/AU2010/001112 filed 27 Aug. 2010, published 3 Mar. 2011 as WO2011/022784, and claiming the priority of Australian patent application 209904147 itself filed 28 Aug. 2009, whose entire disclosures are herewith incorporated by reference.

FIELD OF THE INVENTION

The present invention is related to flags and, in particular, devices for protecting flags. In this specification the term "flag" should be understood to also include such means as banners, pennants, standards, colors, jacks, ensigns, streamers, pennons, banderoles, gonfalons or the like. The present invention may also be useful for other means where protection of same is desired.

BACKGROUND AND PRIOR ART

Flags are used to display indicia for nation states, sporting teams, clubs, societies and are appreciated by a community of vexillologists throughout the world. Furthermore, flags are often used for advertising, signaling in shipping, warning signs and many other purposes.

Flags are often displayed in an elevated position from flag poles. Some flag poles are very tall and so a flag must be raised toward the top of the flag pole using, for example, a halyard. Some flags are displayed in positions that are difficult to access, such as at the side of tall buildings, on ship masts, on buoys at sea and other locations. Raising and lowering of flags can be a time consuming and, sometimes, even a dangerous process. Some flags must be raised every morning and lowered every evening.

Furthermore, flags need to be protected from certain weather conditions such as rain, wind, hail and storms. If such weather conditions appear imminent, or are prevailing, then a flag may need to be lowered. Once the inclement weather has subsided or passed, the flag may then need to be raised for display once more.

As a result, a flag may need to be attended by a person who raises and lowers the flag at the start and end of each day and lowers the flag in advance of, or during, bad weather conditions. Providing such attendance may be inconvenient and/or expensive. The problem may be magnified where there are many flag installations, 30 which require attendance. Sometimes a choice is made to leave flags displayed despite potentially damaging conditions as it may be considered that the cost of replacing or repairing a flag is less than the cost of an attendant.

Additionally, where there are many flag installations requiring attendance, it can be difficult to lower all flags quickly for bad weather conditions. Should some flags remain displayed when the bad weather conditions prevail, these flags may be subject to wear and tear or significant damage.

Flags may be very expensive. This is especially the case where a flag has been custom designed or is a very large flag. It may, therefore, be expensive (and time consuming) to repair a damaged flag.

Previously, flags may have been somewhat protected by devices which attempted to shelter the flag from bad weather conditions when the flag is in a display position, such as toward the top of a flag pole. Some of these devices are difficult to use, expensive and/or do not work very well to protect the flag.

Furthermore, some devices result in a further significant problem in that, when protection is no longer needed and it is desired to again display the flag, it is difficult to unfurl the flag. This can lead to frustration and may require complex operations to release and/or properly unfurl the flag. Such complex operations may even involve a person having to scale a tall flag pole to release and/or unfurl the flag.

Yet a further problem exists in that some devices are configured so that it is difficult to raise or lower flags. Some devices may completely prevent raising or lowering flags.

Accordingly, it is an object of the present invention to overcome at least one of the above-mentioned problems and/or disadvantages.

The reference to any prior art in this specification is not, and should not be taken as, an acknowledgment or any form or suggestion that these reference form part of the common general knowledge of a person skilled in the relevant field.

Throughout this specification and the claims which follow, unless the context requires otherwise, the word "comprise", and variations such as "comprises" and 3

"comprising", will be understood to imply the inclusion of a stated integer or step or group of integers or steps but not the exclusion of any other integer or step or group of integers or steps.

SUMMARY OF THE INVENTION

The present invention provides a device for protecting a flag located in a storage space, the storage space having an aperture disposed forwardly of the storage space, such that, when the aperture is uncovered, the flag is able to be displayed, the device including a retractable shutter for substantially covering the aperture, the retractable shutter including a shutter actuator for deploying and retracting the shutter.

In an embodiment, the device may include a divider, disposed rearwardly of the storage space, for substantially preventing contact between the flag, when in the storage space, and a part of the retractable shutter disposed rearwardly of the divider.

The retractable shutter may also include a yoke, disposed at a first end of the retractable shutter, for facilitating gathering of the flag in to the storage space when the retractable shutter is deployed to substantially cover the aperture. The shutter actuator may include a drive belt.

Optionally, the drive belt is a toothed belt which engages with a toothed drive roller for moving the drive belt.

In an embodiment, the first end of the retractable shutter is connected to a first end of the drive belt of the shutter actuator and a second end of the retractable shutter is connected with a second end of the drive belt of the shutter actuator. In this way the retractable shutter and shutter actuator form a loop, such that when the drive belt of the shutter actuator is moved in a first direction, the retractable shutter is caused to be deployed so as to substantially cover the aperture; and, such that when the drive belt of the shutter actuator is moved in a second direction, the retractable shutter is caused to retract so as to uncover the aperture.

The device may also include a drive mechanism for operating the shutter actuator to move in the first and the second directions. In one embodiment, the drive mechanism includes a drive roller disposed at a first end of the loop, and a second roller disposed at a second end of the loop.

In embodiments where the device is situated in a vertically disposed flag pole, the drive roller may be located at or near a lower end of, or below the storage space, and the second roller may be located at or near an upper end of, or above the storage space.

In a further embodiment, the yoke is disposed within the loop, such that a first end of the yoke connects with the first end of the retractable shutter and a second end of the yoke connects with first end of the shutter actuator. Where the device is used in a vertically disposed flag pole, the first end of the yoke may be an upper end and the second end of the yoke may be a lower end.

Optionally, the yoke includes a cradle arm disposed at the second end of the yoke. Furthermore, the drive belt may be connected to a portion of the yoke cradle arm which is disposed rearwardly of the divider with respect to the yoke. The yoke may be configured such that the yoke cradle arm is substantially "U" shaped in cross-section. Each side of the cradle arm, represented by side of the "U", may be connected, respectively, to a side of the yoke and the cradle arm is adapted so that the divider may be disposed between the sides of the "U". The cross bar of the cradle arm, represented by a crossbar of the "U", may be disposed rearwardly of the divider.

Further, in this embodiment, when the shutter is-retracted to uncover the aperture, the cradle arm causes the divider to move forwardly into a first position toward the aperture. This in turn causes the flag to move forwardly toward the aperture. As a result, when the shutter is retracted to uncover the aperture, the flag may be disposed near the aperture, partially through the aperture or fully through the aperture such that the flag is more readily exposed to any wind or breeze. This should allow the flag to readily unfurl.

In another embodiment the shutter is configured such that a portion of the shutter which covers the aperture may form into a shape with a curved cross-section. Where the flag pole has a substantially circular cross-section, the shutter may have a flexibility which allows it to attach a substantially arcuate cross-section, thus complementing the shape of the flag pole where there is a lacuna in the flag pole resulting from the formation of the aperture.

In such an embodiment, the curving of the shutter may allow for a larger storage space and may also provide a more aerodynamically suitable profile. An aerodynamically suitable profile may be useful when a strong wind is blowing in which situation it may be desirable to protect the flag by deploying the shutter to cover the aperture protecting the flag in the storage space. The profile may assist with directing strong wind around the flag pole.

Furthermore, the shutter may be configured so that it may flatten when moving over the second roller. The shutter may be formed from a canvas like material, which is flexible but may substantially protect the flag from rain damage and/or wind damage and/or other sorts of damage which may be caused by environmental conditions.

In yet a further embodiment, the device includes a first mounting block for mounting the drive mechanism and may further include a second mounting block for mounting the second roller. The first mounting block may also include two guides, each guide disposed at a side of the mounting block, for guiding the drive belt, such as to narrow the loop near the guides.

In an embodiment suitable for use in a vertically disposed flag pole, the first mounting block may be located toward a lower part-of the flag pole, such that a person can operate the drive mechanism with a crank handle. The second mounting block may be located at or toward a top part of the flag pole. The second mounting block may also include a mounting point for connecting an upper end of the divider.

Furthermore, the flag may be mounted on a halyard for raising and lowering the flag. The second mounting block may include a mounting point for a pulley for the halyard.

In yet a further embodiment, the divider includes a first part and a second part rearwardly disposed with respect to the first part. In this embodiment, the divider may be formed from a folded over single piece of material.

Optionally, the fold is located at the upper end of the divider wherein the divider mounting point on the second mounting block supports the divider. In this embodiment the divider mounting point is positioned in the crook of the fold.

The lower end of the first portion of the divider may be connected to a lower part of the aperture and a lower end of the second part of the divider may be connected to the first mounting block. In an embodiment, a part of the cradle arm for moving the divider forwardly is disposed between the first part of the divider and the second part of the divider. The cradle arm causes the first part of the divider to move forwardly when the shutter is retracted.

The divider may be formed from a canvas like material, which is flexible such that the divider is able to be moved forward by the cradle arm when the shutter is retracted. The material of the divider should also protect the flag from being damaged and/or being entangled with the shutter actuator. The divider may also protect the flag from being damaged and/or being entangled with other moving and/or non moving parts of the device. Furthermore, the divider may also protect the flag from damage and/or entanglement with other objects, which are not included as parts of the device.

In an embodiment, the configuration of the flag protection device allows for the drive belt of the shutter actuator to be rearward of the first portion of the divider. Such a configuration results from the drive belt being attached to a part of the yoke cradle arm, which is located rearwardly of the first part of the divider, but forwardly of the second part of the divider In yet another embodiment, the first part of the divider may have a curved cross-sectional shape. The curve may be concave with respect to the flag storage space.

Furthermore, the first part of the divider may be configured to be slightly wider than the diameter of the internal space of the hollow flag pole, such that the first part is induced to form into shape with a curved transverse cross-section.

The halyard may be disposed such that a part of the halyard is internal to the flag pole and another part is external to the flag pole. The part of the halyard external to the flag pole is accessible to an operator for hoisting and lowering the flag. The halyard may be operated with a pulley located at or near the top of the flag pole. The halyard pulley may be mounted to the second mounting block of the device. It will be understood that the halyard is intended to operate independently of the device.

It will also be understood that, whilst the forgoing embodiments of the device for protecting the flag have been described in relation to an upright flag pole, it is envisaged that the device may be suitable for flag poles wherein the longitudinal axis thereof is angled with respect to a vertical direction. The device may also be used in flag poles which are disposed substantially horizontally. Furthermore, it will be understood that the device may be used for protecting indicia which are not generally hoisted or lowered.

It will be further appreciated that the device may be adapted for use in very high flag poles. In such applications, the device may include a long shutter actuator such that the drive mechanism may be located in a position which is accessible for a person at ground level.

Alternatively, when the device is used in a very high flag pole, the drive mechanism may include a motor, which is located at a position close to the storage space which would not be readily accessible by a person. In such an embodiment, the shutter actuator may be much shorter than if the shutter drive mechanism were to be located in a position accessible to a person. Furthermore, the drive mechanism motor may be controlled remotely.

While certain exemplary embodiments have been, or will be, described, it is to be understood that such embodiments are merely illustrative of and not restrictive on the broad invention, and that this invention not be limited to the specific constructions and arrangements described since various other changes, combinations, omissions, modifications and substitutions, in addition to those set forth in the above and below paragraphs, are possible. Those skilled in the art will appreciate that various adaptations and modifications of the described embodiments can be configured without departing from the scope and spirit of the invention. Therefore, it is to be understood that, within the scope of the appended claims, the invention may be practiced other than as specifically described herein.

BRIEF DESCRIPTION OF THE DRAWINGS

FIG. 23 is a similar view to FIG. 17, showing a flag raising and lowering mechanism and some of the steps included in lowering the flag, wherein a yoke and flag arm assembly coupler is inserted into the yoke and a flag arm engagement roller is removed from a roller slot in the yoke;

FIG. 24 is a similar view to FIG. 23, wherein the shutter is substantially fully retracted, the yoke, along with the yoke and flag arm assembly coupler is moved toward the upper section of the device, wherein the coupler is engaged with the flag arm assembly;

FIG. 28 is a similar view to FIG. 24, wherein the coupler is engaged with the flag arm assembly, and wherein the yoke, coupler and flag arm assembly are moving toward a position which allows access to the flag through an access aperture;

FIG. 29 is a similar view to FIG. 28, wherein the yoke, coupler and flag arm assembly are substantially adjacent with the access aperture, a first flag is removed and replaced with a second flag, the coupler is disengaged from the flag arm assembly and the yoke and is removed, and the flag arm engagement roller is inserted into the roller slot in the yoke;

DETAILED DESCRIPTION OF EMBODIMENTS OF THE INVENTION

Figure 1:
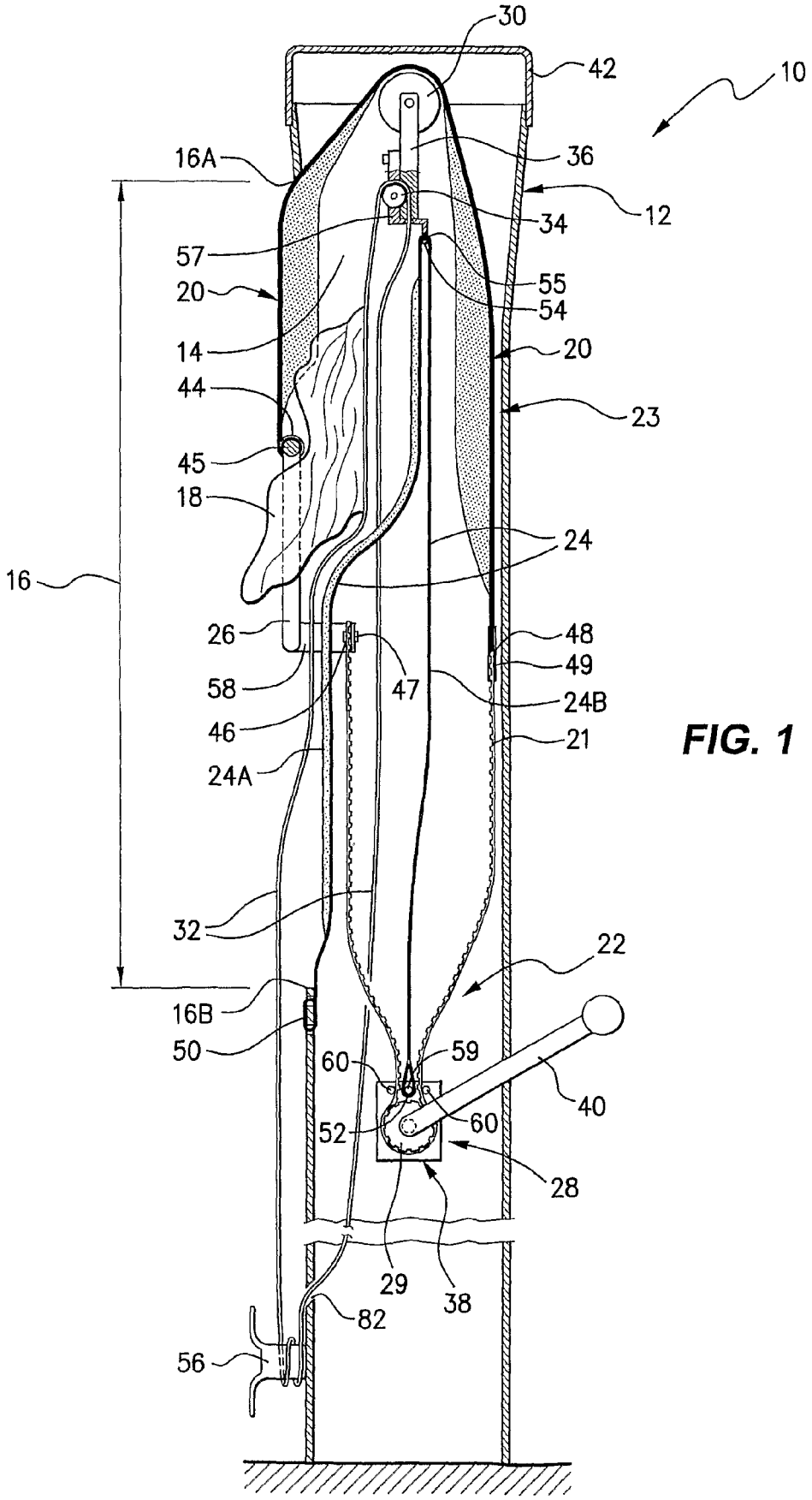
FIG. 1 is longitudinal cross-sectional view of an embodiment of the device for protecting a flag, wherein the shutter is partially deployed so as to cover approximately a half of the aperture.

Before setting forth the detailed explanation of embodiments, it is noted that all of the discussion below, regardless of the particular implementation being described, is exemplary in nature, rather than limiting.

The following description relates to embodiments shown in the drawings of a device for protecting a flag 18 (218), wherein the device is located in a vertically disposed flag pole 12 (212). The flag pole 12 (212)' may be a tubular construction for housing the device 10. The flag 18 (218) is mounted on a halyard 32, (or on a flag arm assembly 300 and halyard 232). The flag 18 (218), when stored by the device 10, is located in a storage space 14 in the hollow flag pole 12 (212). The storage space 14 includes an aperture 16.

It will be understood that the flag pole 12 (212), the flag 18 (218), the halyard 32 (232), the storage space 14 and the aperture 16 of the storage space 14 do not necessarily comprise parts of the device 10.

It will be further understood that the flag pole 12 (212) may be disposed at many different orientations, for example, horizontally. It will be further understood that the device may be housed in other ways, for example, in a billboard for displaying banners.

Relative terms such as "upper", "lower", "rearwardly" or "forwardly" are used in the description of the embodiments to indicate relative positioning of features of the device 10. However, the relative terms apply to the described embodiments where the device 10 is located in a vertically disposed flag pole 12 (212). It will be understood that these relative terms may be changed mutandis mutandi for different applications and orientations of the device, for example, where the device 10 is used in a horizontally disposed flag pole.

FIGS. 1 to 15 show first embodiments of the device 10.

The flag pole 12 is shown in FIG. 1 with a discontinuity, which indicates that the flag pole may be of any selected height. The flag pole includes a flag pole cap 42, which may be removable for access to the flag pole 12 and/or access to the device 10. The cap 42 may be attached to the flag pole 12 via a screw thread or bayonet mount or friction fit.

The flag 18 may be of various shapes and dimensions, which are suitable to be flown from the flag pole 12. It will be understood that the device 10 is suitable for use with other types of indicia, such as banners, pennants, standards, colors, jacks, ensigns, streamers, pennons, banderoles, gonfalons or the -like: The device 10 may also be used for other indicia, such as, for example, posters or bills.

The storage space 14 is located in, and toward an upper part, of the hollow flag pole 12. The storage space 14 is of a size and shape suitable for storing flags or other indicia. The space 14 may also be formed so as to be suitable for storing a plurality of flags, such as may be the case in, for example, marine applications.

The aperture 16 in this embodiment is formed by removing a portion of the tubular flag pole 12. The aperture 16 extends longitudinally from an upper end 16A to a lower end 16B and is located forwardly of the storage space 14.

The device includes a shutter 20, which may be deployed and retracted to, respectively, cover and uncover the aperture 16. In this embodiment the shutter is formed from a flexible material such that, when the shutter 20 is deployed to cover the aperture 16, it forms into a shape with a substantially arcuate transverse cross-section. The arc is curved outwardly with respect to the storage space 14. As a result, a part of the shutter 20, which covers the aperture 16, substantially complements the shape of the tubular flag pole 12.

The shutter 20 includes a shutter actuator 22, which operates to deploy and retract the shutter. In this embodiment the shutter actuator 22 includes a drive belt 21 (or shutter actuator belt), wherein the drive belt 21 and the shutter 20 form a loop 23. When the drive belt 21 of the shutter actuator 22 is moved in an anticlockwise direction in FIG. 1, the shutter 20 is caused to be deployed to cover the aperture 16. When the drive belt 21 is moved in a clockwise direction in FIG. 1, the shutter 20 is caused to be retracted to uncover the aperture 16.

The device 10 includes a yoke 26, which, in this embodiment is disposed within the loop 23. An upper part of the yoke 26 is joined to the shutter 20 at a first loop connection point 44 and a lower part of the yoke 26 is connected to the shutter actuator belt 21 at a second loop connection point 46. The yoke 26 is configured so as to assist with gathering the flag 18 into the storage space 14 when the shutter 20 is deployed. The yoke 26 may also include a cradle arm 58, wherein the second loop connection point 46 is disposed on the cradle arm 58 in a location relatively rearward of the yoke 26. The yoke may be configured such-that the yoke cradle arm 58 is substantially "U" shaped in cross-section. The top of each side of the cradle arm, represented by sides of the "U", is connected, respectively, to a side of the yoke 26. The cradle arm 58 is connected to a lower part of the yoke 26.

In this embodiment, the device 10 includes a third loop connection point 48 between a second end of the shutter 20 and a second end of the drive belt 21.

The shutter 20 connects to the yoke 26 at the first loop connection point 44 via a mounting bar 45 at an upper part of the yoke. The part of the shutter 20 which connects to the yoke 26 at connection point 44, wraps around the mounting bar 45 and is fixed by any suitable means. Such means may include gluing, stapling, riveting or a combination of such means or any other suitable fixing.

The drive belt 21 connects to the cradle arm 58 at the second loop connection point 46, which may be effected by means such as, for example, a rivet 47.

The connection between the drive belt 21 and the shutter 20 at the third loop connection point 48 may be effected by a connection tube 49, wherein the second end of the shutter 20 and the second end of the drive belt 21 are inserted into the tube. The end of the shutter and the end of the drive belt may be fixed inside the tube 49 by gluing or by crimping the tube 49, where the tube 49 is formed from a material that will hold ends of the drive belt and the shutter when crimped, or by any other suitable means.

It will be understood that connections at the first loop connection point 44, the second loop connection point 46 and the third loop connection point 48 may be effected by any suitable means. The connections 44, 46 and 48 are not limited to the embodiments described herein.

The device 10 also includes a drive mechanism 28, including a drive roller 29 for causing the drive belt 21 to move and operate the shutter 20. The drive mechanism 28 may be manually operated, as shown in the embodiment of FIG. 1, by a crank handle 40. It will be appreciated that the drive mechanism 28 may also be operated by other means, such as, for example, a motor 90 (refer to FIG. 14).

It will be understood that, in an embodiment including a manually operated drive mechanism 28, such a drive mechanism may be located in a lower part of the flag pole for ready access by a person operating the device.

The device 10 may also include a second roller 30, which in this embodiment is disposed above the flag storage space 14 at an upper part of the flag pole 12. The shutter 20, when operated to retract or deploy, moves over the second roller 30, such that, when retracted, a portion of the shutter 20 is moved to a position rearward of the storage space 14. The shutter 20, in this embodiment, is formed from a flexible material, which substantially flattens when moving over the second roller 30. The flexible material may be, for example, a canvas or canvas-like material. The material may be laminated with a water resistant layer for protection.

The device 10 includes a first mounting block 38 for mounting the drive mechanism 28 and includes a second mounting block 36 for mounting the second roller 30.

The first mounting block 38 also includes two guides 60, each guide disposed at a side of the first mounting block 38. The guides 60 may be formed from substantially cylindrical tins and are for guiding the drive belt 21 so as to narrow the loop at and near the guides 60. The guides 60 may prevent the drive belt 21 from moving loosely when the drive mechanism 28 is operated. Such loose movement may result in damage to other parts of the flag device and/or damage to the flag and/or damage to other parts in the flag pole not included with the device 10.

In the embodiment shown in FIG. 1, it may be seen that the shutter 20, the yoke 26 and the drive belt 21 form an elongate loop, wherein the drive roller 29 is located at one end of the elongate loop and the second roller 30 is located at the other end of the elongate loop.

The device 10 also includes a divider 24 for protecting the flag from other parts of the device 10, for example, the shutter actuator belt 21. The divider 24 also serves as a means to push the flag 18 forwardly toward or through the aperture 16 when the shutter 20 is retracted.

The divider 24, in this embodiment, includes a first part 24A and a second part 24B, with the second part 24B disposed rearwardly with respect to the first part 24A.

The divider 24 is formed from a folded over single piece of material. The divider 24 is flexible and may be formed from canvas or canvas-like material. The fold 55 is located at the upper end of the divider 24, between the first part of the divider 24A and the second part of the divider 24B.

A divider mount 54 is located on the second mounting block 36 for supporting the divider 24. The divider mount 54 is positioned in the crook of the fold 55 of the divider 24, such that the divider 24 rests on the divider mount. The divider mount 54 may be a substantially cylindrical bar, which is connected to the second mounting block 36, using any suitable means, by a divider mount connector 57.

A lower end of the first part of the divider 24A connects at or near the lower part of the aperture 16B. In this embodiment, the connection 50 is effected by a closed loop in the lower end of the first part of the divider 24A, the closed loop passing through two slots formed in the flag pole 12 at or near the lower part of the aperture 16B.

In an alternative embodiment, the lower end of the first part of the divider 24A may also connect at a lower point than shown in FIG. 1. In this regard, the lower end of the first part of the divider 24A can be connected at or near the halyard aperture 82 (described below).

A lower end of the second part of the divider 24B connects to the first mounting block 38. In this embodiment, the connection 52 is effected by a closed loop in the lower end of the second part of the divider 24B, the closed loop passing around a cylindrical bar 59.

The forward movement of the divider 24, which pushes the flag 18 forward through the aperture 16, is effected by the cradle arm 58 of the yoke 26. The cradle arm 58 is positioned such that, when the shutter 20 is retracted and the yoke 26 moves toward the upper end of the aperture 16A, the cradle arm 58 causes the first part divider 24A to move forwardly into the flag storage space 14, which impels the flag 18 toward or through the aperture 16.

The first part of the divider 24A is caused to move forwardly progressively, as the shutter 20 is retracted, from a lower part of the first part of the divider 24A to an upper part of the first part of the divider 24A. The first part of the divider 24A can also resist or substantially prevent contaminants such as water, dust, or the like, from entering into parts of the device 10. In this regard, parts of the device such as the drive belt 21, the shutter actuator 22, the drive roller 29, and various other parts of the device 10 are substantially protected from contamination by substances which may impair operation of the device, or degrade performance of the device over time. Accordingly, the divider may be formed from material which is substantially water-proof and/or dust-proof and/or substantially resistant to other contaminating substances. In this regard, the divider 24 may be formed from a canvas or canvas-like material with a plasticized coating.

The flag 18 is mounted on a halyard 32. The halyard 32, in this embodiment, is a cord which forms a loop. The loop is represented in FIG. 1 with a discontinuity, so that it will be understood that the halyard may be of sufficient length to be readily manually operated when used with a flag pole 12 of a selected height.

Parts of the halyard 32 are located inside and outside the hollow flag pole 12. A part of the halyard 32 passes from inside a lower part of the flag pole 12 through a halyard aperture 82 to outside a lower part of the flag pole. The halyard aperture 82 is located near the base of the flag pole 12. Another part of the halyard 32 passes through the aperture 16 of the storage space 14 so as to be in the storage space. Another part of the halyard 32 passes between a side of the first part of the divider 24A and an upper part of an inner side of the flag pole 12. Yet another part of the halyard passes between the drive belt 21 and a lower part of the inner side of the flag pole 12. A further part of the halyard 32 passes toward the previously-mentioned inside lower part of the flag pole, thus completing the halyard loop.

The halyard 32 is mounted on a halyard pulley 34, such that it can be readily moved in directions to raise and lower the flag 18. In this embodiment, the halyard pulley 34 is mounted to the second mounting block 36. In other embodiments, the pulley 34 may be mounted at another suitable location, which is not a part of the device 10. Furthermore, the halyard 32 is secured in a position on a cleat 56 to prevent unwanted movement of the halyard.

It will be understood that the halyard 32 is intended to operate substantially independently of the device 10.18

Figure 2:
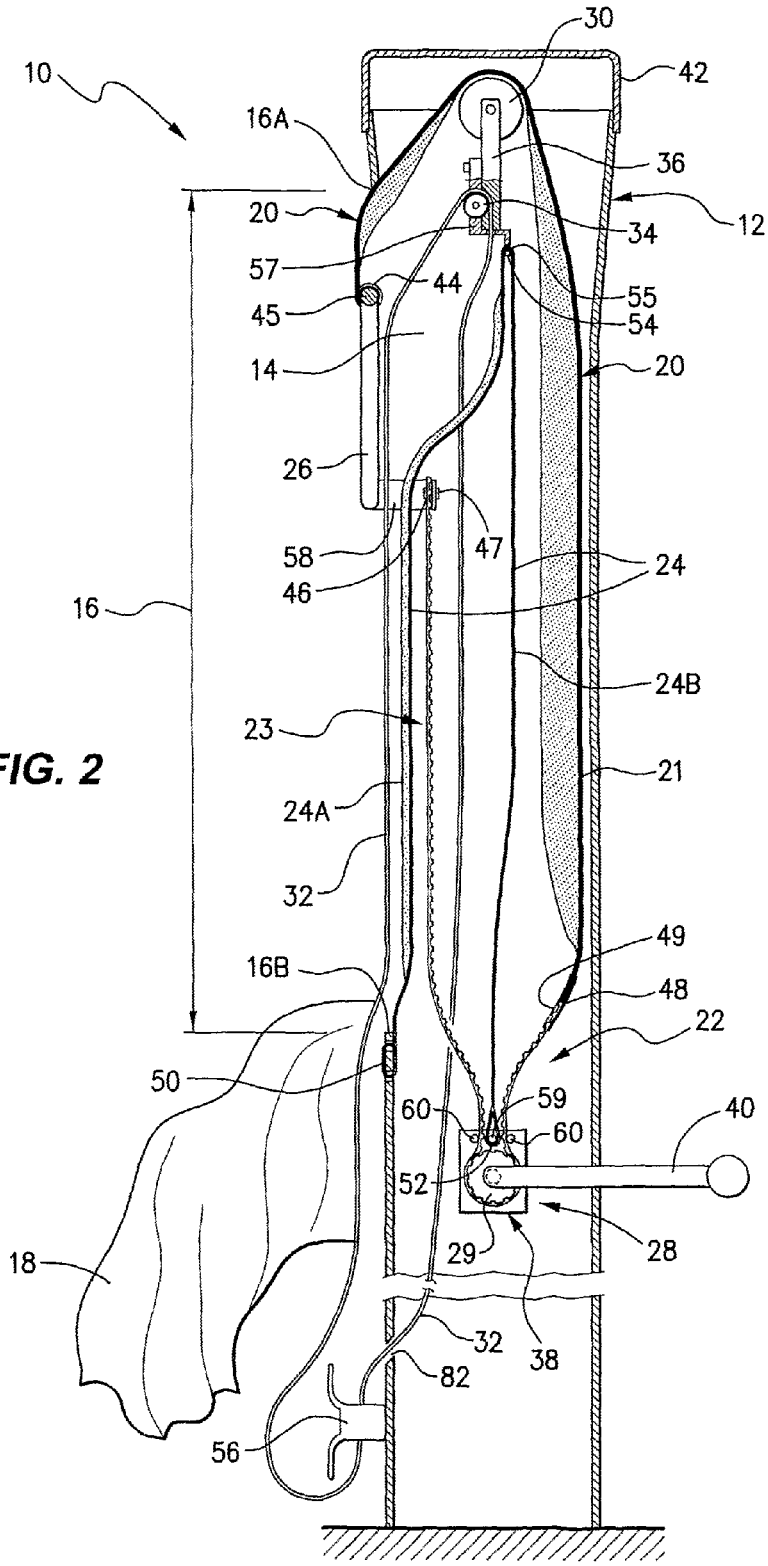
FIG. 2 is a similar view to FIG. 1, wherein the shutter is substantially fully retracted, the aperture is uncovered and the flag is lowered.

FIG. 2 shows a configuration of the device 10 wherein the shutter 20 is substantially fully retracted. The flag 18 has been lowered on the halyard 32. This allows for the flag to be changed and/or removed for maintenance.

The yoke 26 is at or near the top part of the aperture 16A, wherein the yoke arm 58 is pushing forward a top part of the first section of the divider 24A. As the first part of the divider 24A is also connected to the flag pole 12, at or near the lower part of the aperture 16B, the lower section of the first part of the divider 24A is impelled to a forward position. The forward position of the lower section of the first part of the divider 24A is located at or near the aperture 16.

Figure 3:
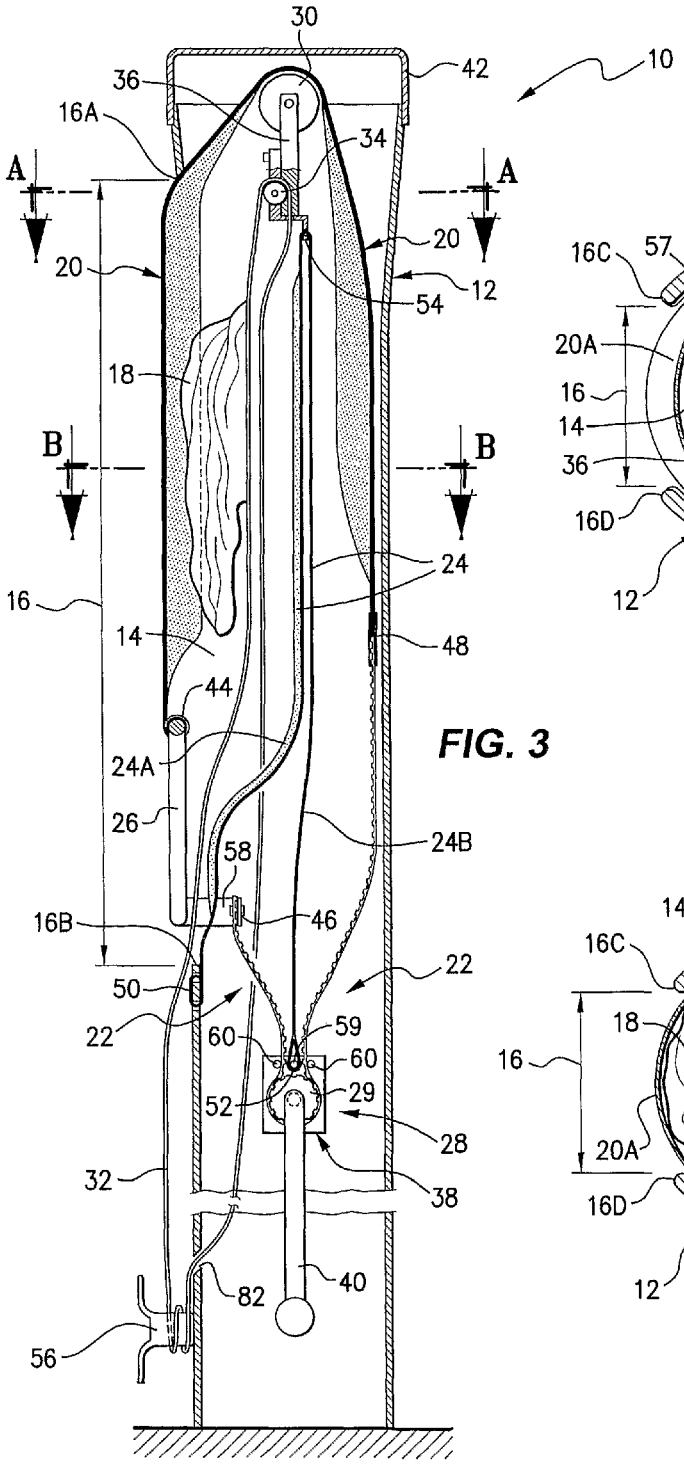
FIG. 3 is a similar view to FIG. 1, wherein the shutter is substantially fully deployed, the aperture is covered and the flag is in the storage space.

FIG. 3 shows a configuration in which the flag 18 is stored in the storage space 14 in the hollow tubular flag pole 12. The shutter 20 is substantially fully deployed, such that the lower part of the yoke 26 is near the lower part of the aperture 16B.

When the shutter 20 is deployed, the cradle arm 58 of the yoke 26 is moved toward the lower part of the first part of the divider 24A. As a result, the first part of the divider 24A is allowed to move rearwardly with respect to the storage space 14, such that the flag 18 is able to be stored in the storage space 14.

As the yoke 26 moves downwardly during; deployment of the shutter 20, the flag 18 is gathered and pushed into the storage space 14. Furthermore, the yoke 26 and/or the shutter 20 may push against the flag 18, which in turn may push against the first part of the divider 24A, such that the first part of the divider 24A is pushed in a rearward direction.

Figure 4:
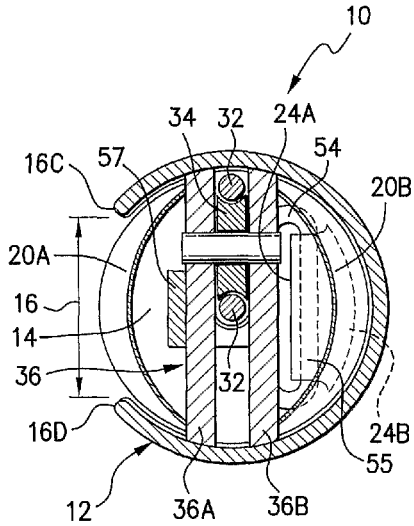
FIG. 4 is a cross-sectional view along and in the direction of arrows A-A of FIG. 3.

FIG. 4 shows a plan cross-sectional view of FIG. 3, across line A-A, in which a part of the shutter 20 located at or near the top part of the aperture 16A can be seen on the left side of FIG. 4. This part of the shutter 20 shows the transition in transverse cross-sectional shape of the shutter from being substantially flat when moving over the second roller to having a substantially arcuate transverse cross-sectional shape (refer to FIG. 5).

FIG. 4 also shows parts of the halyard 32 on either side of the halyard pulley 34. In this embodiment, the pulley 34 is mounted to the second mounting block 36. The second mounting block 36 includes two lower protrusions 36A and 36B, between which the pulley is mounted. The pulley 34 includes an axle, which is connected on one side to a first lower protrusion 36A and is connected on the other side to the second lower protrusion 36B.

The aperture 16, in this embodiment, is formed by removing a part of the cylindrical flag pole 12, wherein the part removed to form the aperture 16 has an arcuate transverse cross-sectional shape. The sides of the aperture 16C and 16D are also shown in FIG. 4.

The fold 55 in the divider 24 is located over the divider mount 54. The divider mount 54 is secured to the second mounting block 36 by the divider mount connection 57.

The second part of the divider 24B is shown in a location toward a rearwardly disposed inner wall of the hollow flag pole 12. Further, the second part of the divider 24B is located rearwardly of the first part of the divider 24A with respect to the storage space 14.

Figure 5:
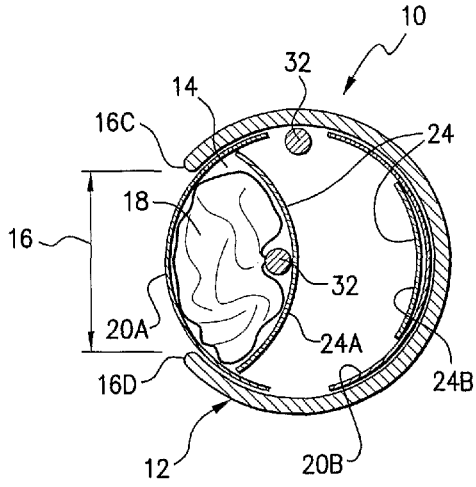
FIG. 5 is a cross-sectional view along and in the direction of arrows B-B of FIG. 3.

FIG. 5 shows a plan cross-sectional view of FIG. 3 across line B-B, in which a first part of the shutter 20A, which is covering the aperture 16 can been seen in a configuration wherein it has a substantially arcuate transverse cross-sectional shape. In this way the first part of the shutter 20A substantially complements the shape of the flag pole 12 across the aperture 16.

The flag 18 can be seen stored in the storage space 14, between the first part of the shutter 20A and the first part of the divider 24A.

The second part of the shutter 20B is located rearwardly of the storage space 14 and adjacent a rear inner wall of the flag pole 12. The second part of the divider 24B is located between the second part of the shutter 20B and the first part of the divider 24A.

It will be understood that the first part of the shutter 20A refers to that part of the shutter 20, whenever it is forwardly disposed with respect to the storage space 14, and the second part of the shutter 20B refers to that part of the shutter 20, whenever it is rearwardly disposed with respect to the storage space 14.

Figure 6:
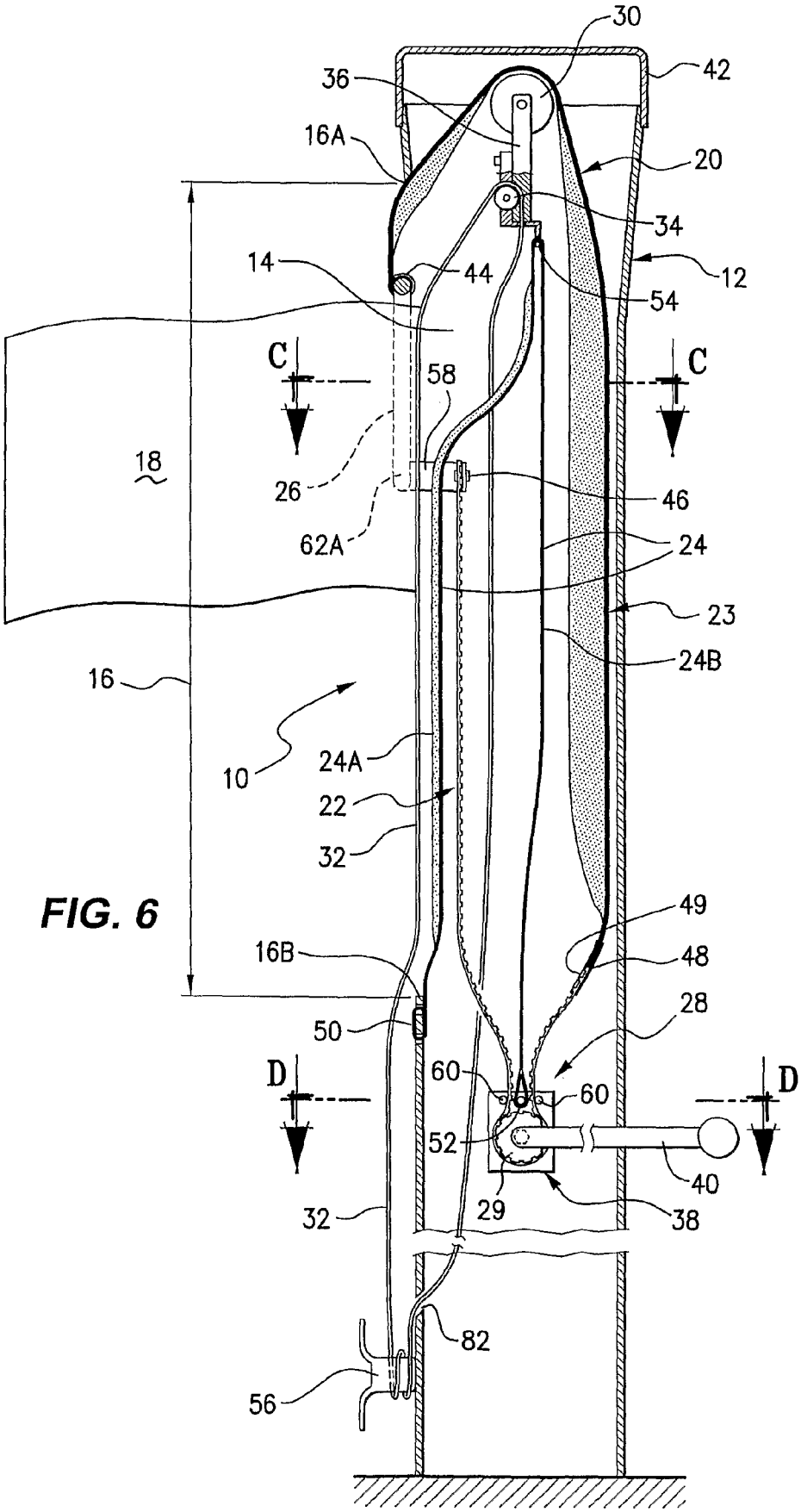
FIG. 6 is a similar view to FIG. 1, wherein the shutter is substantially fully retracted, the aperture is uncovered and the flag is raised and flying.

FIG. 6 shows a configuration wherein the shutter 20 is retracted and the flag 18 is unfurled and deployed.

A lower section of the first part of the divider 24A is in a position at or near the aperture 16, such that it has pushed the flag 18 toward or through the aperture 16. As a result, the flag 18 is more readily exposed to any wind or breeze, which assists in unfurling and deploying the flag 18.

When the shutter 20 is substantially fully retracted, the yoke cradle arm 58 is located at or near the upper part of the aperture 16A and the cradle arm 58 pushes forward an upper part of the first part of the divider 24A. A lower part of the first part of the divider 24A is connected to the lower, part of the aperture 16B. As a result, the lower part of the first part of the divider 24A is also located in a position at or near the aperture 16. Thus, the lower section of the first part of the divider 24A, located between the connection 50 and the lower part of the yoke 26, is in a forwardly disposed position, which is at or near the aperture 16.

Figure 7:
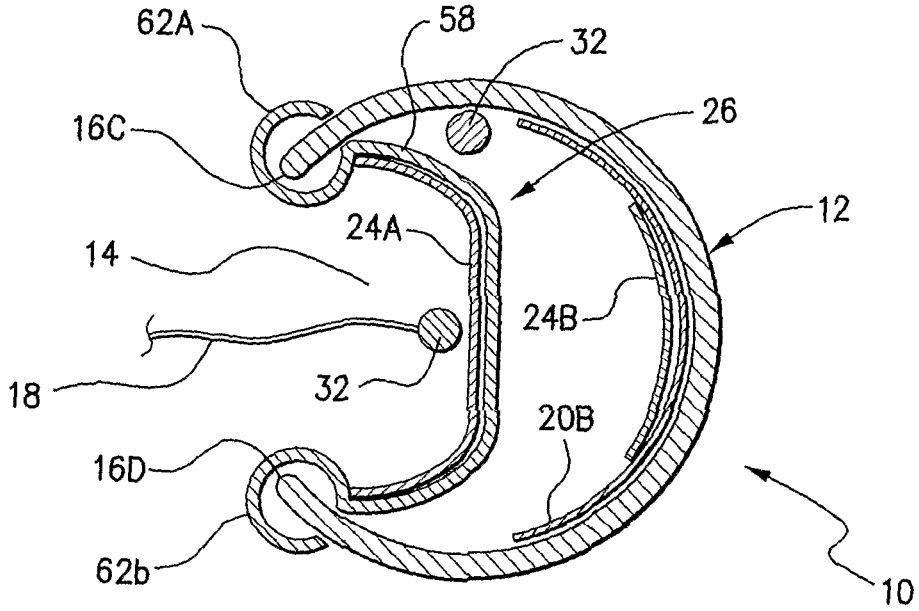
FIG. 7 is a cross-sectional view of along and in the direction of arrows C-C of FIG. 6.

FIG. 7 is a plan cross-sectional view of FIG. 6 across line C-C. In this embodiment of the device 10, the yoke includes two substantially cylindrical guides 62A and 62B-on either side of the yoke 26. The guides 62A and 62B each have an elongate slot, such that the sides of the aperture 16C and 16D are engaged by the guides 62A and 62B by being inserted, respectively, into the slots of the guides.

An upper part of the first part of the divider 24A is pushed forwardly by the cradle arm 58 of the yoke 26.

The flag 18 is deployed through the aperture 16, and a part of the flag 18 is located between the guides 62A and 62B of the yoke 26.

Figure 8:
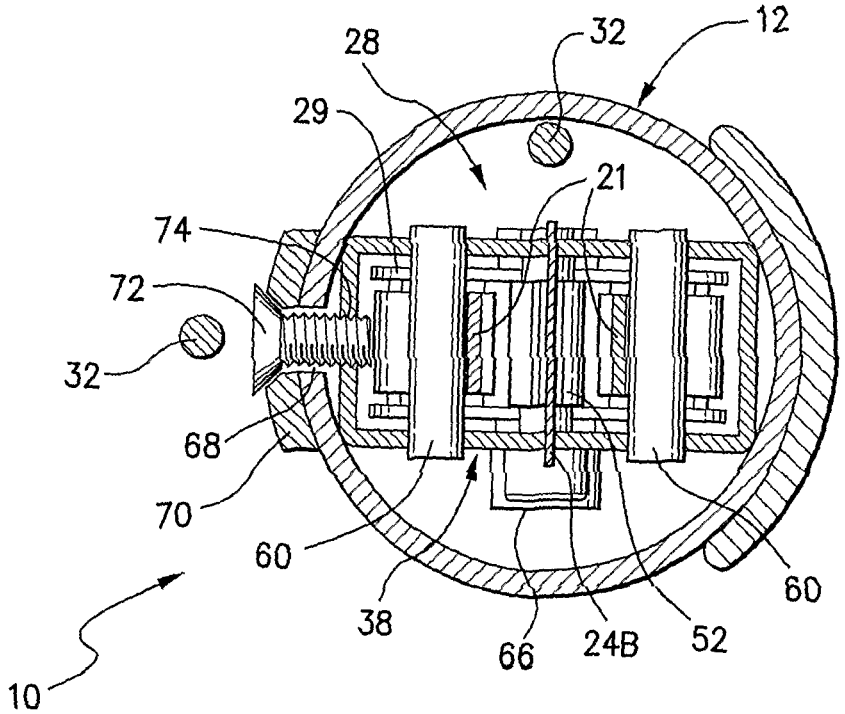
FIG. 8 is a cross-sectional view along and in the direction of arrows D-D of FIG. 6.

FIG. 8 shows a plan cross-sectional view of FIG. 6 across line D-D, which depicts a part of the drive mechanism 28 of the device 10.

The first mounting block 38 is attached at a lower position in the flag pole 12 via an attachment means. In this embodiment, the first mounting block 38 is slidably mounted inside the flag pole 12. The slidable mounting allows for adjustable tensioning of the loop 23 formed by the shutter 20, the yoke 26 and the drive belt 21.

The slidable mount for the first mounting block 38 includes a slot 68 over which there is a cover 70. A securing means secures the cover 70 in place over the slot 68, wherein the securing means 72 is secured into a connection point 74 on the first mounting block 38. In this embodiment, the securing means 72 includes a screw, which is operable by an alien key.

When the securing means 72 is sufficiently loosened, the cover 70 and the first mounting block 38 are slidable in a direction corresponding with the slot 68, such that the loop 23 can be suitably tensioned.

When the securing means 72 is sufficiently tightened, the cover 70 and the first mounting block 38 are secured such that they do not move with respect to the slot 68.

In this embodiment, the screw securing means 72 screws into a threaded bore 74 in the first mounting block 38.

In FIG. 8, a part of the drive belt 21 can be seen between the guides 60, which are located each on a side of the first mounting block 38.

Furthermore, the drive mechanism 28 includes a connector 66 for the crank handle 40. The crank handle connector 66, in this embodiment, includes a hexagonal bore into which a hexagonal end 86 (refer to FIG. 10) of the crank handle 40 is slotted. The axis of crank handle connector 66 is, coaxial with the drive roller 29. This arrangement allows for the crank handle 40, when rotated, to operate the drive mechanism 28.

Figure 9:
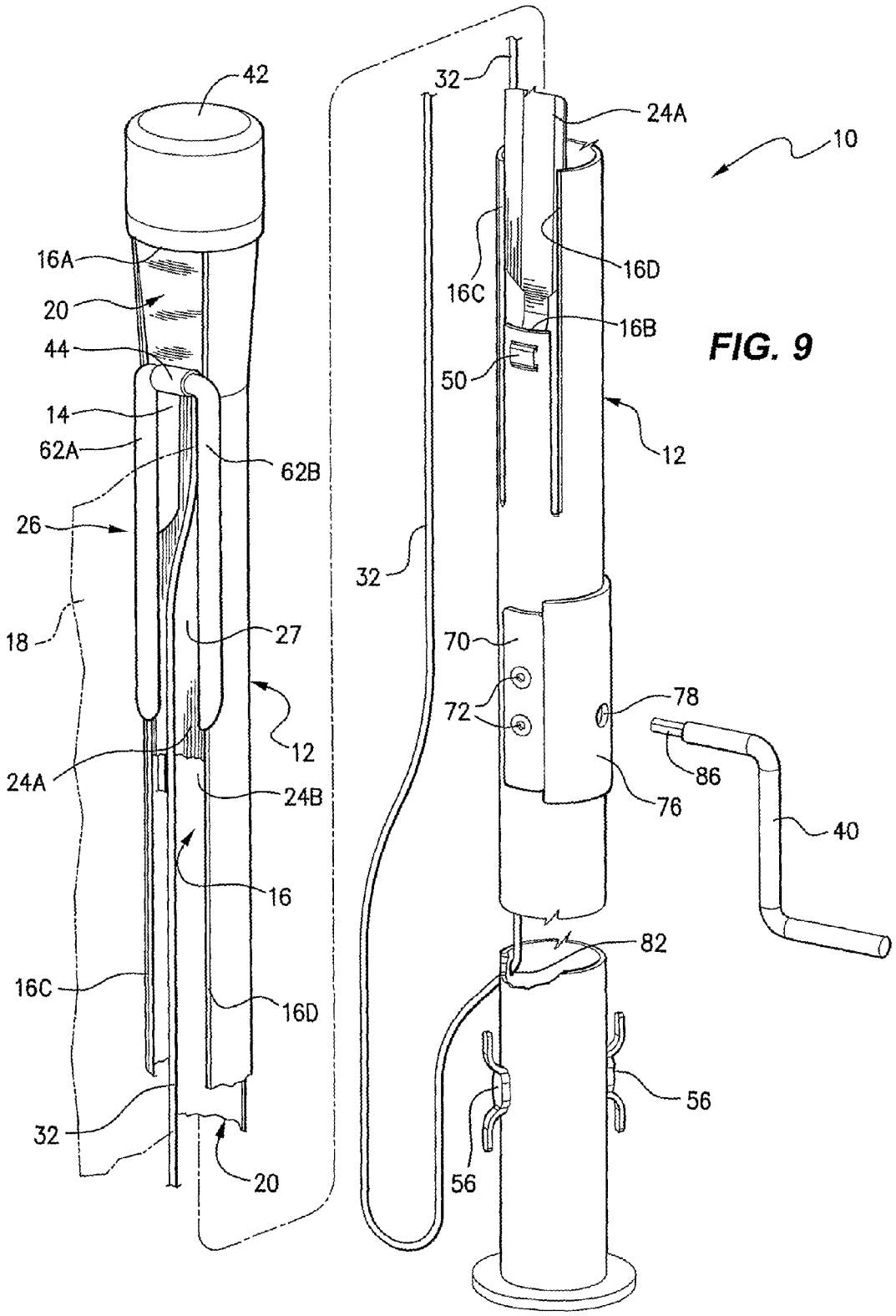
FIG. 9 is a broken perspective view of the device shown in FIG. 1.

FIG. 9 shows the device 10, wherein the shutter 20 is substantially fully retracted.

The yoke 26 includes a yoke slot 27 formed between the yoke guides 62A and 62B. When the shutter 20 is deployed, the flag 18 is gathered by the yoke 26 in the yoke slot 27.

Also shown in FIG. 9 is a first mounting block access cover 76, which is detachably attached to the flag pole 12. The first mounting block access cover 76 includes an aperture 78. The crank handle 40 slots through the aperture 78 so that the hexagonal end 86 of the crank handle 40 can skit into the handle connector 66.

In the embodiment shown in FIG. 9, there are two cleats 56 mounted to the flag pole 12 at a forward and rearward location.

Further, in FIG. 9, the securing means 72 includes two screws, each operable with a hex key (alien key).

Figure 10:
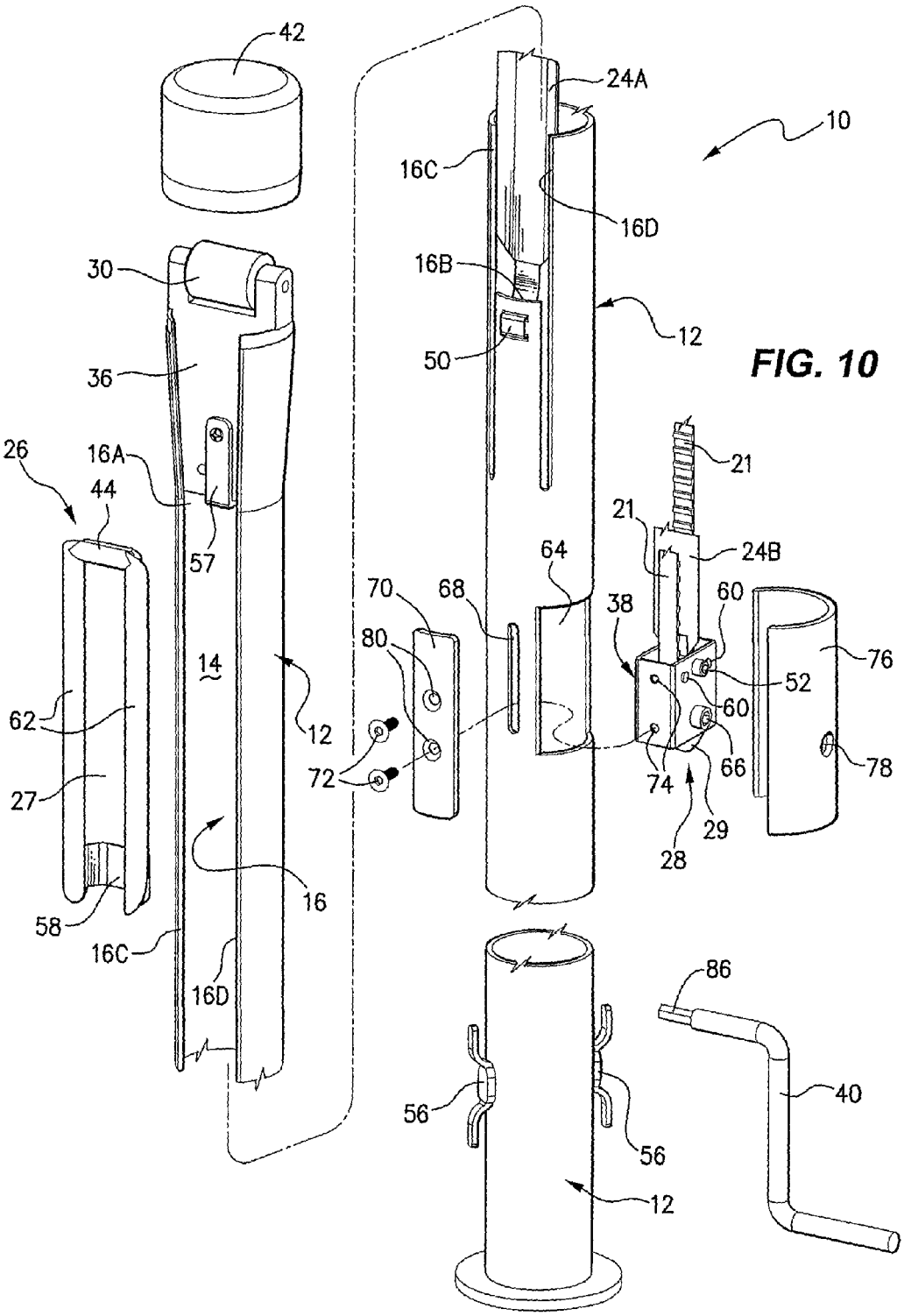
FIG. 10 is an exploded view of FIG. 9 (the flag and halyard are not shown in FIG. 10)

FIG. 10 is an exploded view of FIG. 9. In this view, the divider mount connection 57 can be seen screwed into the second mounting block 36. The second roller 30 is mounted on an axle between two upper protrusions of the second mounting block 36. A lower part of the second part of the divider 24B is shown as being located between two sides of the drive belt 21.

Also shown in FIG. 10 is an access aperture 64 for the first mounting block 38. The access cover 76 fits over the aperture 64. In this embodiment, the access cover 76 has a transverse cross-section which is acuate, wherein the arc is greater than 180. The access cover 76 is resiliently flexible, such that it can snap on around the flag pole 12 to cover the aperture 64.

The slot 68 is formed in the flag pole 12 close to the access aperture 64. The slot cover 70 includes two holes 80, through width screw securing means 72 are placed when securing the first mounting block 38. The lower screw securing means 72 goes through the lower hole 80 in the cover 70, and then through the slot 68 and into the lower threaded bore 74 in the first mounting block 38. This is shown by a dashed line in FIG. 10.

Figure 11:
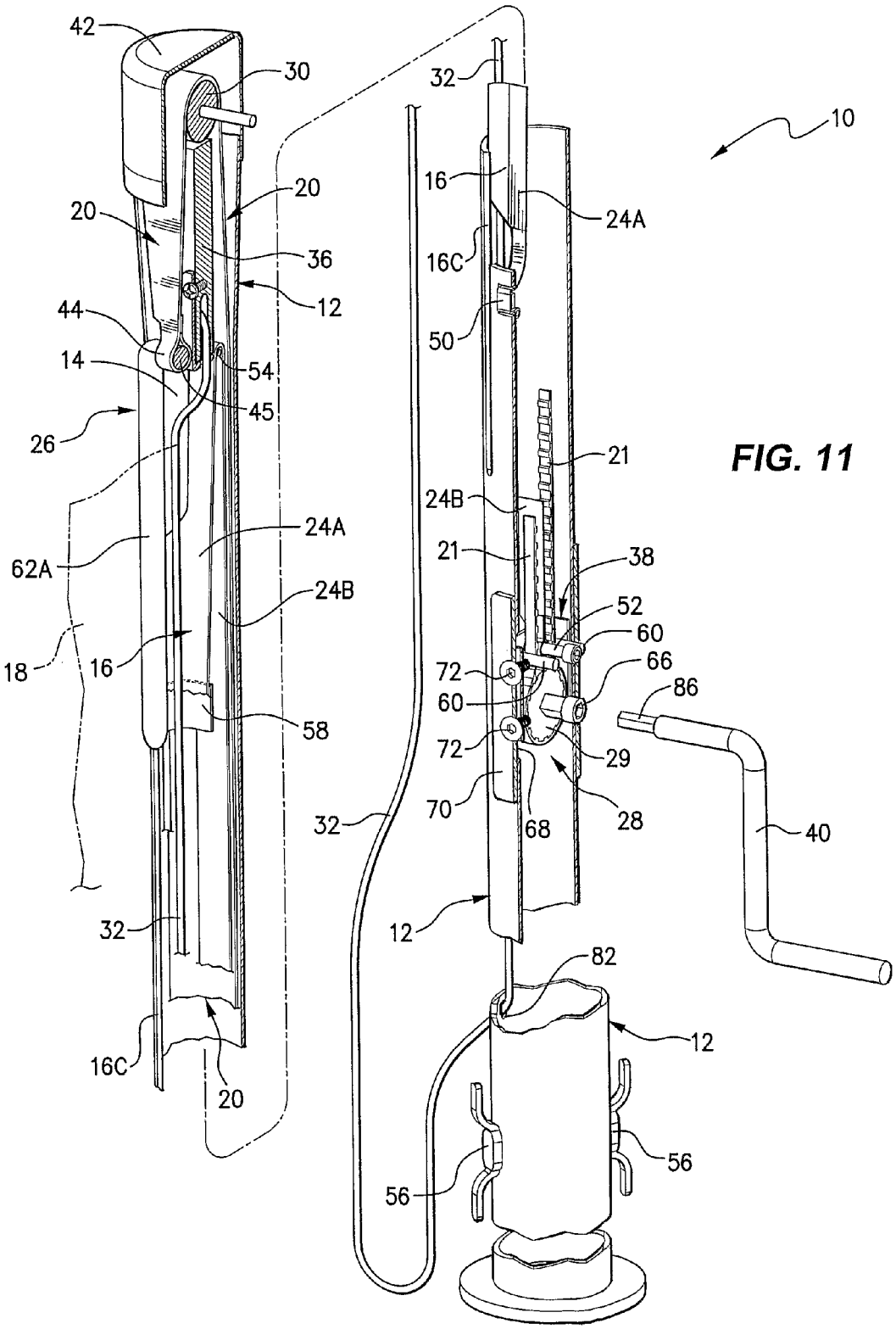
FIG. 11 is a longitudinal cross-sectional view of FIG. 9.

In FIG. 11 the shutter 20 can be seen connected to the yolk at the first loop connection point 44, wherein a part of the shutter 20 wraps around the mounting bar 45 and is fixed by any suitable means.

Figure 12A:
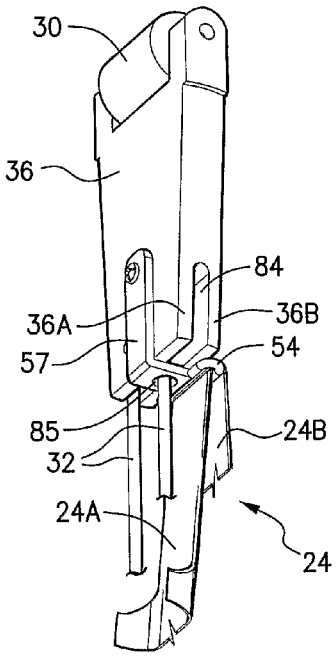
FIG. 12A is a perspective view of an embodiment of the second mounting block, which, in a vertically disposed flag pole may be located in an upper part of the flag pole.
Figure 12B:
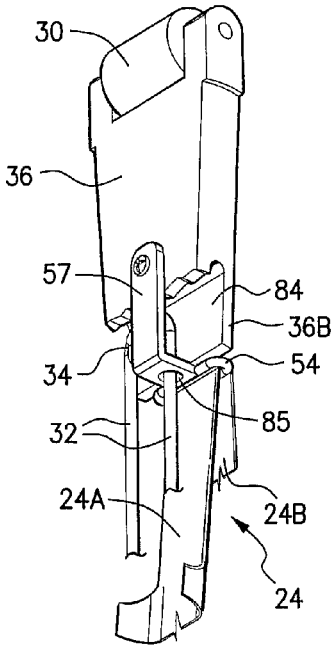
FIG. 12B is a similar view to FIG. 12A, wherein a portion of the mounting block has been cut away in order to more readily view the pulley for the halyard.
Figure 12C:
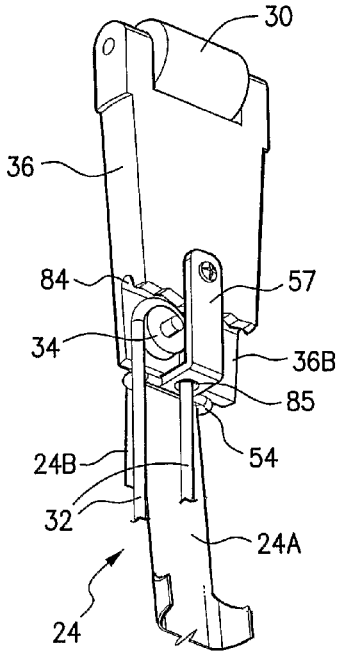
FIG. 12C is a similar view to FIG. 12B, rotated at approximately 90°.

FIGS. 12A, 12B and 12C show details of the second mounting block. The divider mount connection 57 includes an aperture '85 through which the halyard 32 can move. The second mounting block 36 includes a slot 84 formed between two lower protrusions 36A and 36B of the second mounting block 36. The halyard pulley 34 is mounted in the slot 84. (FIGS. 12B and 12C are views where one lower protrusion 36A has been cut away for a clearer view of the halyard pulley 34).

The first part of the divider 24A includes 'a thinner upper section which is adjacent the fold 55. The first part of the divider 24A widen at a lower section, such that the width of the widened part of the divider is larger than the internal diameter of the hollow flag pole 12. As a result, the widened part of the first part of the divider 24A has a curved transverse cross-sectional shape.

Figure 13:
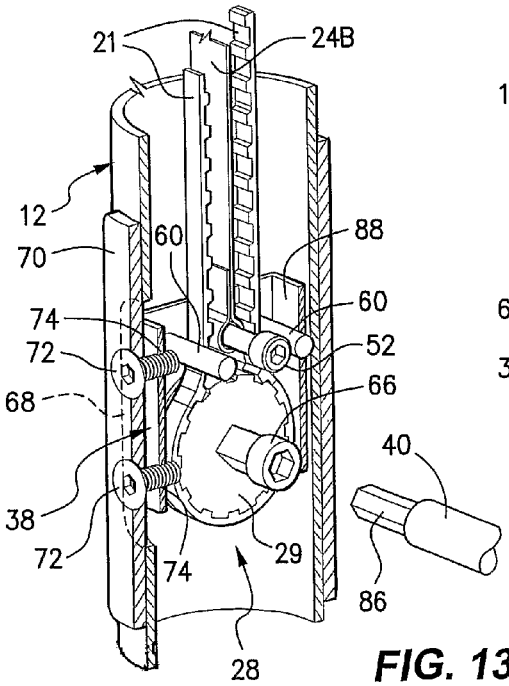
FIG. 13 is a cross-sectional perspective view of an embodiment of the first mounting block, including a manually operated drive mechanism.

FIG. 13 shows details of the first mounting block 38 and drive mechanism 28. The mounting block 38 includes a mounting block casing 88. The drive roller 29 is mounted on an axle which is connected at each side, respectively, to a side of the mounting block casing 88. Each guide 60 has two ends and each end of a guide connects, respectively, to opposing sides of the mounting block casing 88. The guides 60 are connected to the mounting block casing 88.

Figure 14:
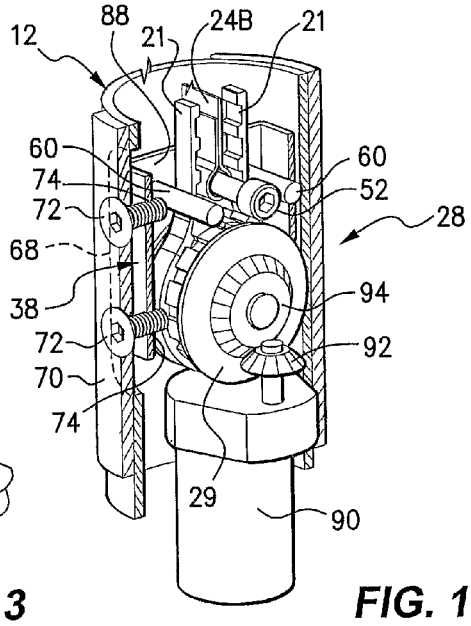
FIG. 14 is a similar view to FIG. 13, however, the embodiment shown includes a motor driven drive mechanism.

FIG. 14 shows an embodiment of the device 10, wherein the drive mechanism 28 is operated by a motor 90. The motor 90 transfers rotational movement to the drive roller 29 via a motor transfer gear 92 which drives a drive roller cog 94 to move the drive roller 29 clockwise and anticlockwise, which in turn allows the drive belt 21 to move in directions for retracting and deploying the shutter 20.

Figure 15:
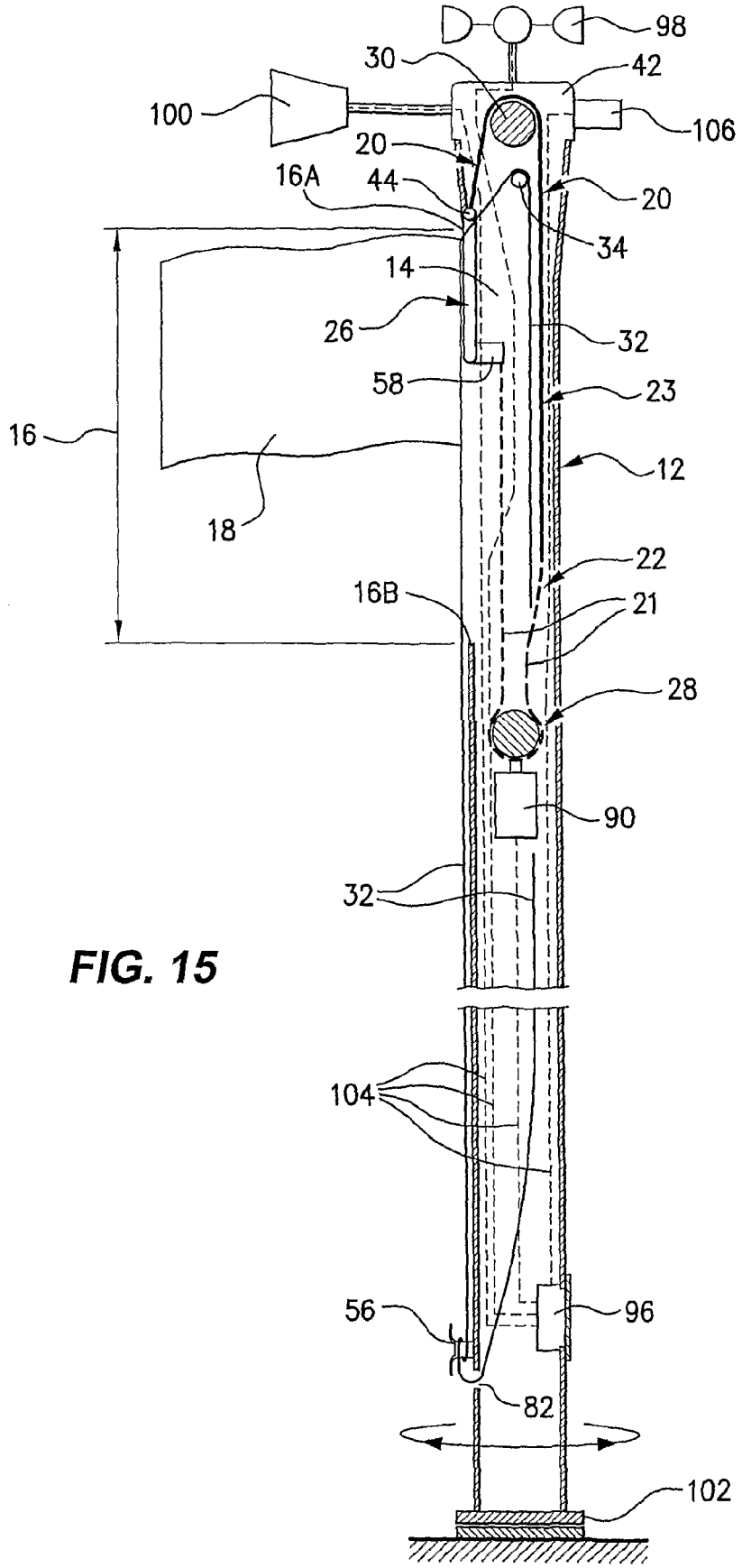
FIG. 15 is a longitudinal cross-sectional view of the device, including various optional features, wherein the shutter is substantially retracted, the aperture uncovered and the flag is flying.

FIG. 15 shows an embodiment of the device 10 including various automated control mechanisms. The control mechanisms include sensors for sensing various weather conditions, wherein the sensors send data via wiring 104 to a control 96. The control 96 controls the motor 90, which moves the drive belt 21.

A wind sensor 98 is located at or near the top of the flag pole 12. The wind sensor 98 is adapted to measure wind strength. When the wind strength or average wind strength over a preselected period, is deemed to be too high, the control 96 signals the motor 90 to operate the drive mechanism 28 in order to deploy the shutter 20 in order to protect the flag 18.

The wind sensor 98 may work in conjunction with the control 96 to measure instantaneous wind strength or average wind strength over a preselected time period. Wind strength may vary rapidly and so measuring average wind strength over a preselected time period prevents unnecessary deploying and retracting of the shutter. This may result in prolonging the operating life of the device 10 and/or minimize maintenance requirements for the device.

A precipitation sensor 106 is located at or near the top of the flag pole 12. The precipitation sensor 106 is for detecting rain and/or other types of precipitation that may cause damage to a flag 18. When such precipitation is detected, the precipitation sensor 106, working in conjunction with the control 96, operates the motor 90 to deploy the shutter 20 in order to protect the flag 18.

The precipitation sensor 106, operating with the control 96, may include logic for determining when precipitation has reached or surpassed a predetermined threshold. Furthermore, the precipitation sensor 106 and control 96 may measure 20 average precipitation over a predetermined time period, so as to minimize unnecessary operating of the device 10.

In an embodiment, the flag pole may be mounted on a swivel 102, such that it may rotate clockwise or anticlockwise about a longitudinal axis of the flag pole 12. A wind vane 100 is located at or near the top of the flag pole 12 and protrudes radially from the flag pole 12 in a direction which is forward of the aperture 16. In this way, the flag pole may be rotated such that the aperture faces a direction substantially corresponding to the direction of the wind.

FIGS. 16 to 32 show other embodiments of the device 10.

Figure 16:
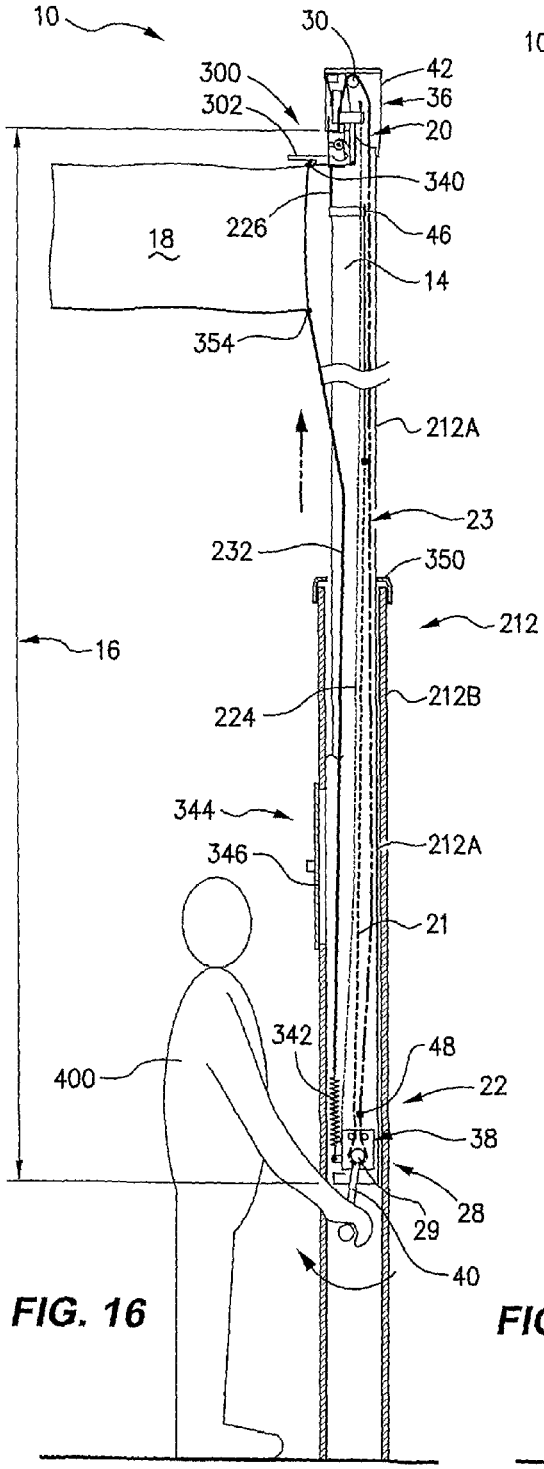
FIG. 16 is a longitudinal cross-sectional view of another embodiment of the device, including a flag arm assembly, wherein the shutter is substantially fully retracted, the aperture is uncovered and the flag is raised and flying.

In the embodiment shown in FIG. 16, the device includes an optional flag arm assembly 300, which can assist with unfurling and flying the flag 18. The flag arm assembly 300 includes a flag arm 302 onto which the flag 18 may be attached via a flag attachment means 340, which in this embodiment is a hook that engages with a top eyelet 356 (refer to FIGS. 20 and 21) of the flag 18.

The flag arm 302 is attached to a flag arm carriage 306 via a rotatable mount 308. The rotatable mount 308 allows the flag arm 302 to rotate from a substantially vertical position, for storage of the flag 18 in the storage space 14, to a substantially horizontal position, when the flag is deployed.

The flag arm carriage 306 includes flag arm carriage guides 307A and 307B, located on either side of the flag arm carriage. The guides 307A and 307B engage with sides of the aperture 16, such that the flag arm carriage 306 can slide up and down the aperture 16. In embodiments, the guides are configured in such a way to provide resistance against sliding up and down the sides of the aperture. In this way, unless a force is applied to the flag arm carriage 302, it should not slide along the aperture (where the flag arm carriage is to be moved downwardly, the force must be additional to the gravitational force).

In this embodiment, the flag pole 212 includes an upper section 212A and a lower section 212B. In this embodiment, the lower section 212B is of greater radius than the upper section 212A. Optionally, the tube of upper section 212A is made from a thinner material than the tube of lower section 212B.

The aperture 16 in upper section 212A extends from toward the top of upper section 212A to toward the bottom of the upper section 212A. As shown in FIG. 16, the upper section 212A extends through the inside of the tube of lower section 212B and the bottom of upper section 212A is at about waist height of an operator 400. A flange 350 is located at the top of the lower section 212B.

The flange 350 assists with securing the upper section 212A in a position when the upper section is inserted into the lower section 212B. Furthermore, the flange is configured to include a space 352 adjacent the aperture 16, such that the yoke 226 and the flag arm assembly 300 can move past the flange 350. In this way, the yoke 226 and the flag arm assembly 300 are able to move from a part of the upper section 212A of the flag pole 212 to a lower part of the upper section 212A of the flag pole 212, wherein the lower part is located within the lower section 212B of the flag pole 212.

In the embodiment shown in FIG. 16, the yoke 226 engages with the flag arm 302 so as to cause the flag arm 302 to be rotated into a horizontal position, wherein the flag is deployed.

Figure 30:
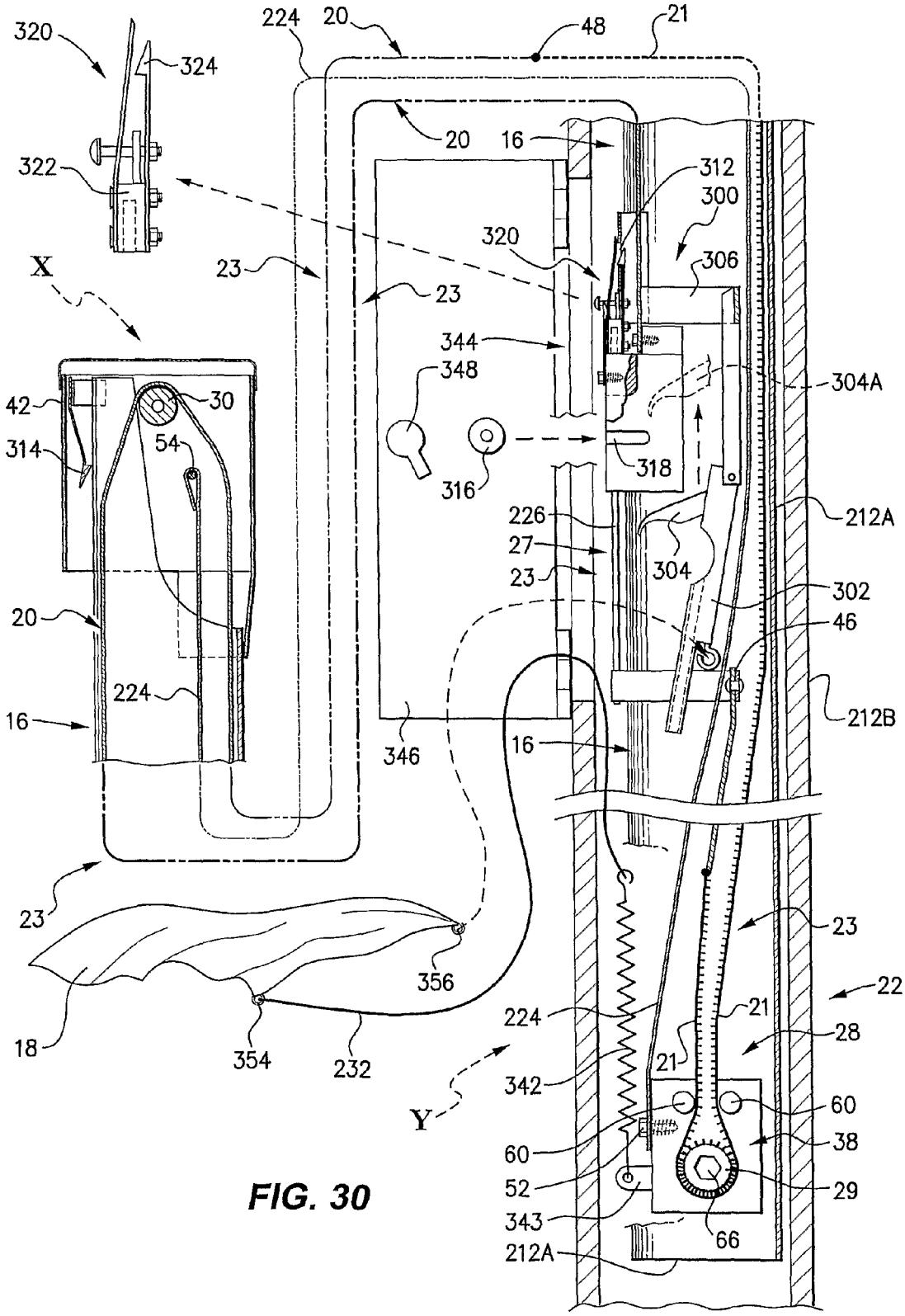
FIG. 30 is a broken longitudinal cross-sectional view of the device and showing a similar view of steps included in the flag changing process as shown in FIG. 29, wherein the flag is extracted and is ready to be changed.

Furthermore, in this embodiment, the halyard 232 is not formed as a movable loop, such as shown in earlier embodiments in FIGS. 1 to 15, instead the halyard 232 extends from a halyard eye 354 at a bottom corner of the flag 18 down to a halyard spring 342 which is mounted on the first mounting block 38 via an anchor point 343 (see FIG. 30). As such, the halyard 232 is not used to raise or lower the flag, instead, the flag is raised and lowered by raising or lowering the flag arm assembly 300, to which the flag 18 is attached.

Figure 17:
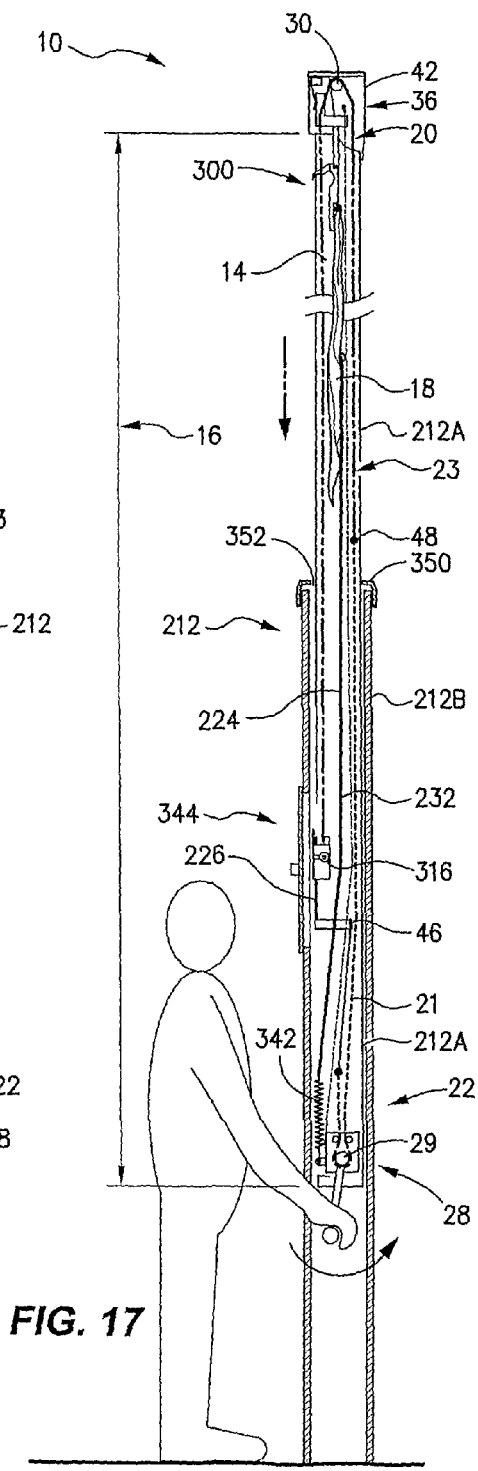
FIG. 17 is a similar view to FIG. 16, wherein the shutter is substantially fully deployed, the aperture is covered and the flag is in the storage space.
Figure 18:
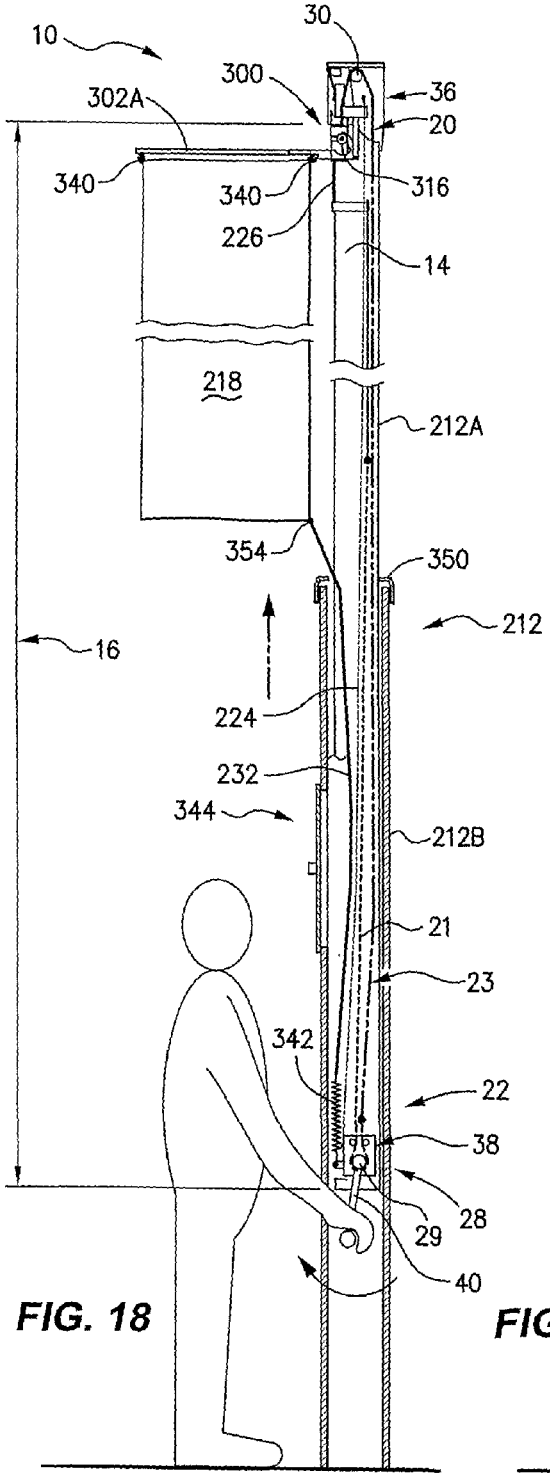
FIG. 18 is a longitudinal cross-sectional view of yet another embodiment, including a flag arm assembly for use with a banner type flag, wherein the shutter is substantially fully retracted, the aperture is uncovered and the flag is raised and flying.
Figure 19:
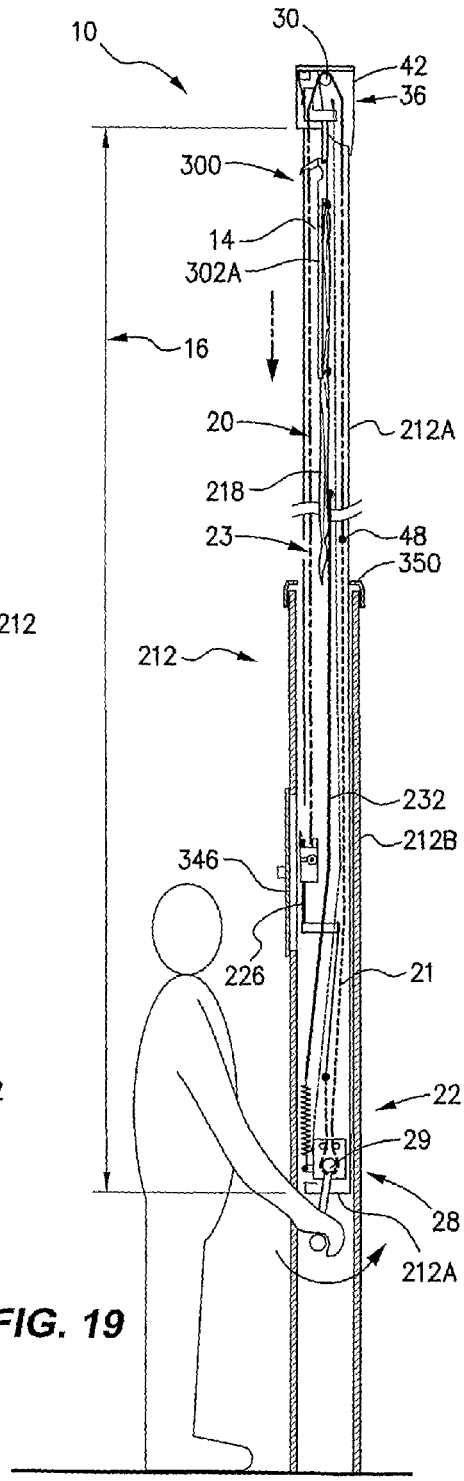
FIG. 19 is a similar view to FIG. 18, wherein the shutter is substantially fully deployed, the aperture is covered and the flag is in the storage space.

In FIG. 17, the shutter 20 is deployed and the yoke 226 has been lowered to be adjacent the access aperture 344. The means for lowering the yoke and deploying the shutter are substantially the same as described, in earlier embodiments shown in FIGS. 1 to 15, whereby the operator 400 winds the crank handle 40 to rotate the drive roller 29, which moves the drive belt 21 and the loop 23 (including the yoke 226, the drive belt 21 and the shutter 20) moves in an anti-clockwise direction (as shown in FIG. 17), such that the shutter 20 is deployed.

Furthermore, when the yoke 226 disengages from the flag arm 302, the flag arm rotates into a substantially vertical position with the flag inside the storage space.

It should be noted that a small part of the flag arm 302 is shown as if it is protruding through the shutter 20. However, when the shutter 20 is deployed, all parts of the flag arm 302 are inside the storage space 14 and covered by the shutter 20.

As shown in the embodiments in FIGS. 16 to 32, the divider 224 is not "doubled over", as for the embodiment of the divider 24 shown in FIGS. 1 to 15. Instead, an upper end of the divider 224 is fixed to the second mounting block 36 and a lower end of the divider 224 is fixed to the first mounting block 38. As with the embodiments described in FIGS. 1 to 15, a rearward part of the cradle arm 58 is located rearwardly of the divider 224 with respect to the storage space 14.

FIGS. 18, 19, 31 and 32 show an alternative embodiment including a longer flag arm 302A. The longer flag arm 302A is adapted to be used with a banner-type flag 218. In this embodiment, the flag arm 302A includes two flag arm hooks 340 for engagement with eyelets located at two corners on the top of the banner-type flag 218.

Figure 20:
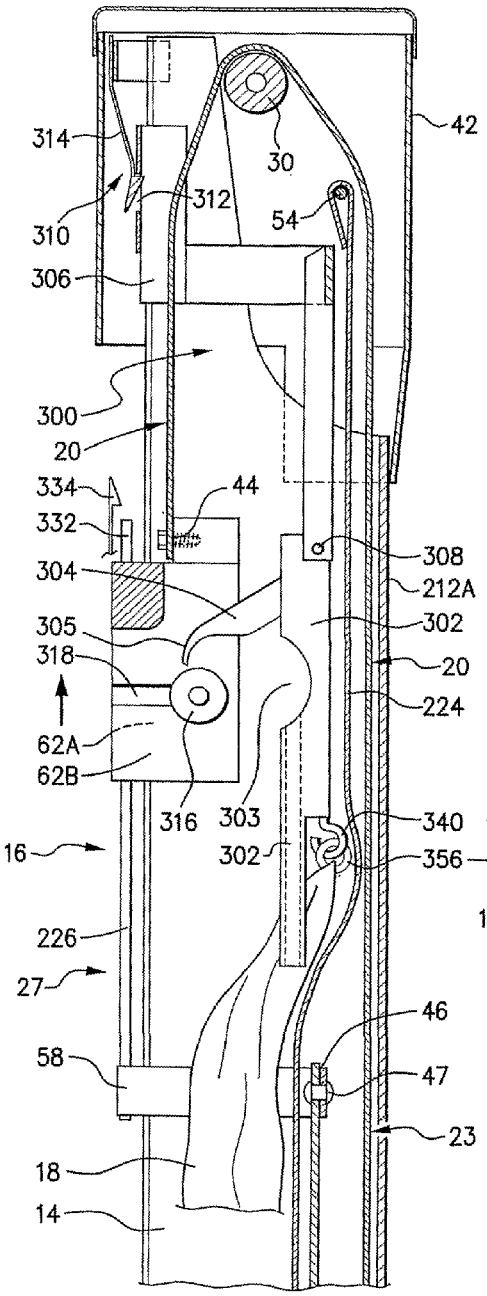
FIG. 20 is a detailed view of the embodiment shown in FIGS. 16 and 17, wherein the shutter is being moved toward a substantially fully retracted position, the yoke is coming into contact with the flag arm assembly such that the flag will be raised and flying.
Figure 21:
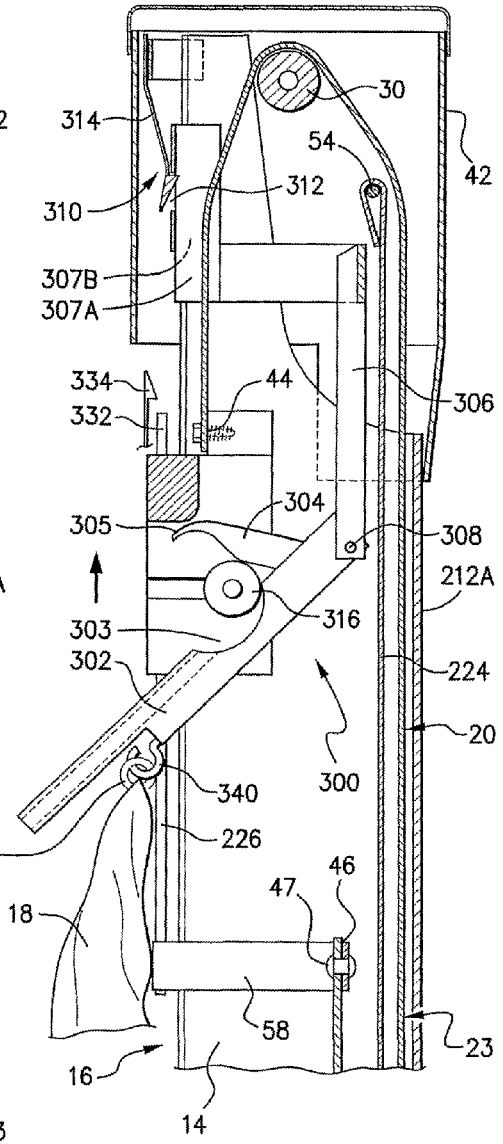
FIG. 21 is a similar view to FIG. 20, wherein the yoke is in contact with the flag arm assembly and the flag is moving further toward being raised and flying.
Figure 22:
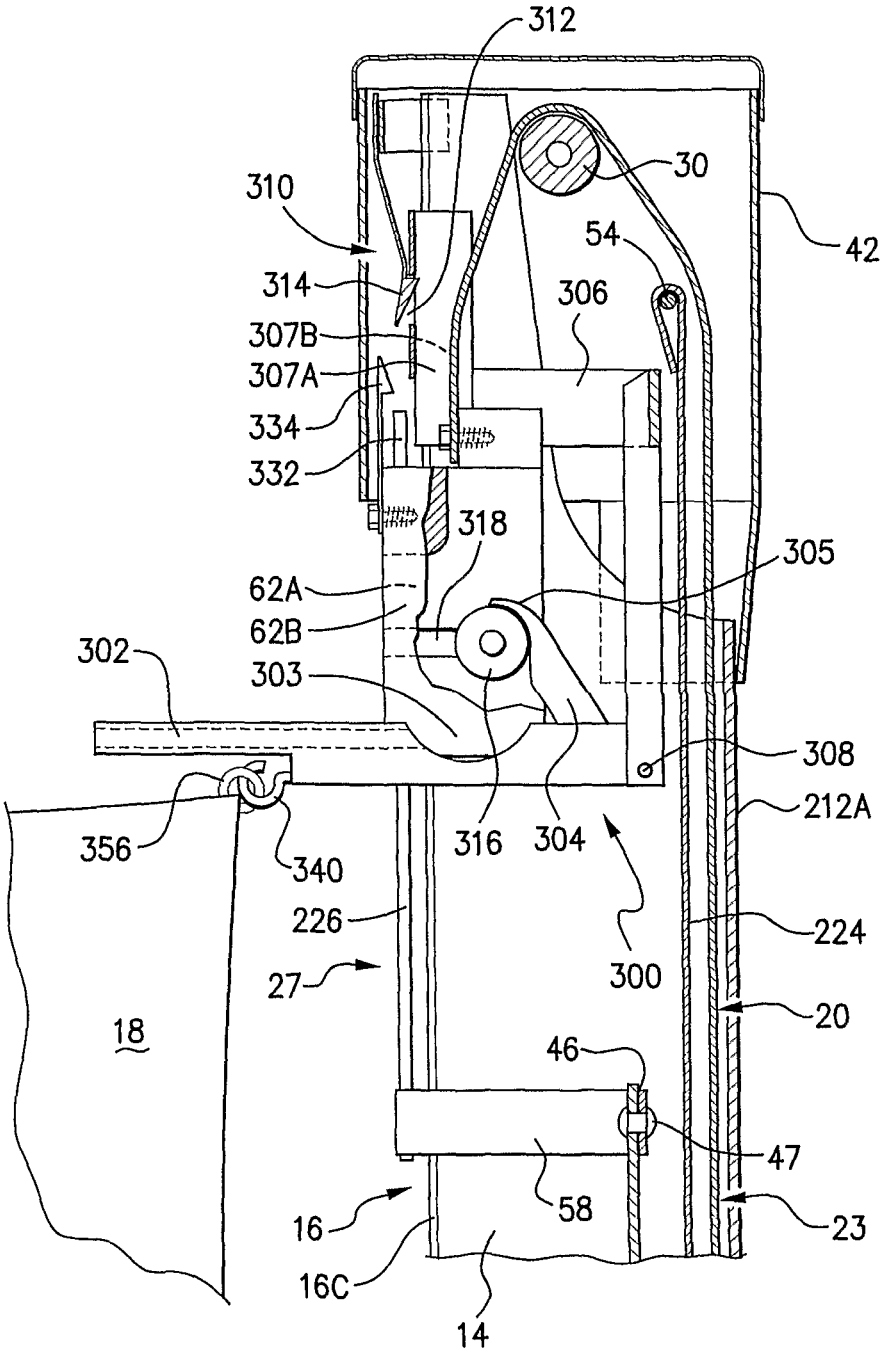
FIG. 22 is a similar view to FIGS. 20 and 21, wherein the shutter is substantially fully retracted, the aperture is uncovered, the yoke is engaged with the flag arm assembly such that the flag is raised and flying.

FIGS. 20, 21 and 22 show details of the embodiments in FIGS. 16 and 17. The detailed views in FIGS. 20, 21 and 22 show a top part of the device 10 in the upper section 212A of the flag pole 212.

In FIG. 20, the yoke 226 is shown with a flag arm engagement roller 316 which is located in a roller slot 318. As will be shown in later figures, the roller 316 can be removed from the roller slot 318.

Further in FIGS. 20, 21 and 22, the flag arm assembly 300 is shown in more detail. The flag arm assembly includes the flag arm carriage 306 and the flag arm 302, which is mounted to the flag arm carriage via the rotatable mount 308, such that the flag arm can move between substantially horizontal and substantially vertical positions.

The flag arm carriage 306 includes carriage guides 307A and 307B on either side of the flag arm carriage. The carriage guides engage with sides of the aperture 16. The guides 307A and 307B are configured for substantially non-frictional engagement with the sides of the aperture 16, such that only a small amount of force need be applied to move the flag arm carriage 306.

The flag arm 302 includes a flag arm lever 304, which is fixed to the flag arm so as to form an angle. The flag arm lever includes a lever hook 305 at an end of the flag arm lever 304.

The flag arm assembly 300 includes a flag arm carriage lock mechanism 310 for retaining the flag arm carriage 306 in a position toward the top end of the device 10. The lock mechanism 310 includes an aperture 312 in the flag arm carriage 306 and a locking arm 314 which may be located on the second mounting block 36. The locking arm 314 is formed from spring steel and include a barb at one end, which engages in the aperture 312, so as to retain the flag from assembly 300 in the position toward the top end of the aperture 16.

As shown in FIG. 20, when the yoke moves toward a top part of the device 10, the flag arm engagement roller engages, firstly, with the flag arm lever hook 305. Further, as shown in FIG. 21, as the yoke moved upwardly from the position shown in FIG. 20, the flag arm lever 304 is pushed upward causing the flag arm 302 to rotate about the rotatable mount 308 and to move toward a horizontal position. As the flag arm moves toward the horizontal position, the flag arm engagement roller 316 moves into a flag arm hollow 303, which allows the flag arm 302 to continue moving toward the horizontal position. It will be appreciated that the angle between the flag arm 302 and flag arm lever 304 can be selected so as to assist with operation of the device 10.

FIG. 22 shows the yoke 226 in a substantially uppermost position, wherein the flag arm engagement roller 316 caused the flag arm 302 to move into a substantially horizontal position. In the substantially horizontal position, the flag arm lever hook 305 rests against the flag arm engagement roller 316, which causes the flag arm 302 to remain in the substantially horizontal position.

The flag arm 302, when in the substantially horizontal position, has a downward force component acting on it due to its own mass and also due to the mass of the flag 18 under the influence of gravity. The downward force component on the flag arm 302 results in there being a horizontal component of force acting on the flag arm lever hook 305 via the flag arm lever 304. The flag arm lever hook 305 is configured such that at least a part of the horizontal component of force is transmitted to the flag arm engagement roller 316. Accordingly, the roller slot 318 can be configured so that the roller 316 is not forced out of the slot when the horizontal component of the force is acting on the roller.

Furthermore, the horizontal component of the force acting on the flag arm engagement roller 316 in turn causes a horizontal component of force to act on the yoke 226. As a result, the yoke guides 62A and 62B are pushed against the flag pole 12, at or near the sides 16C and 16D of the aperture 16.

As a result of the horizontal component of force being transmitted to the yoke guides 62A and 62B, the yoke 226 can resist sliding movement. As such, the yoke 226 is substantially prevented from sliding down the aperture 16 under the force of gravity.

FIGS. 23 to 30 show details of a mechanism for lowering the flag 18 and illustrate various steps in a process of operating that mechanism.

FIG. 23 shows an embodiment of a yoke and flag arm assembly coupler 320. The coupler 320 may be attached to the yoke 226 when the yoke is lowered and can be accessed by the operator 400 through the access aperture 344 located in the lower section 212B of the flag pole 212.

Figure 25:
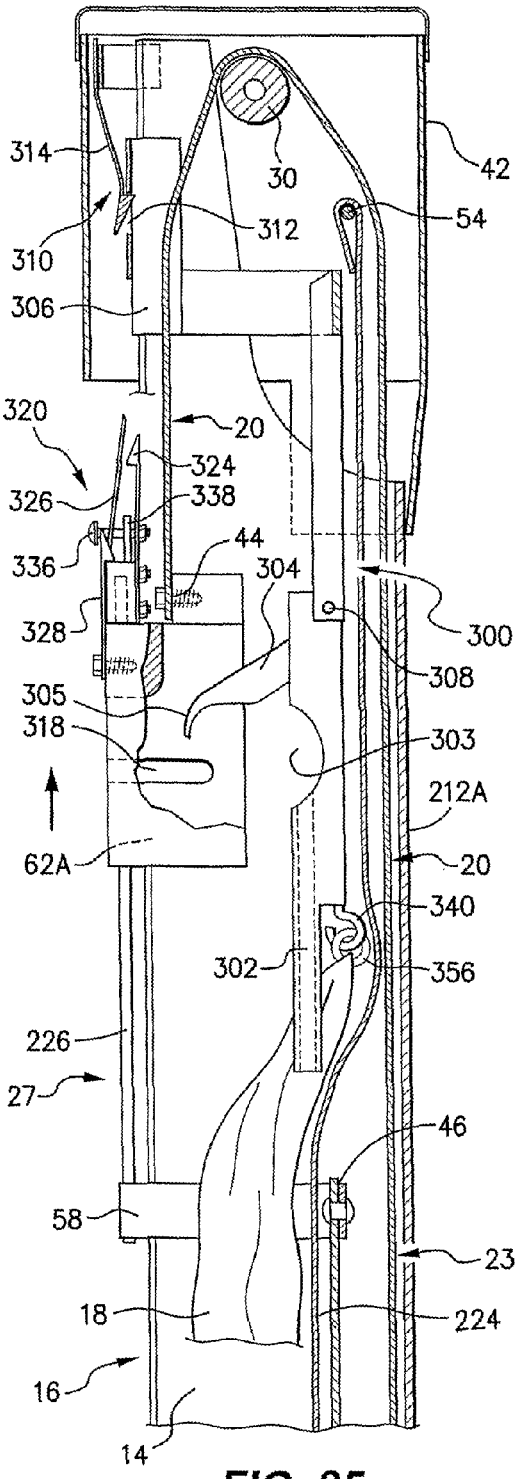
FIG. 25 is a detailed view, wherein the coupler is inserted in the yoke and is being moved toward engagement with the flag arch assembly, and wherein the flag arm engagement roller is removed from the roller slot in the yoke.
Figure 26:
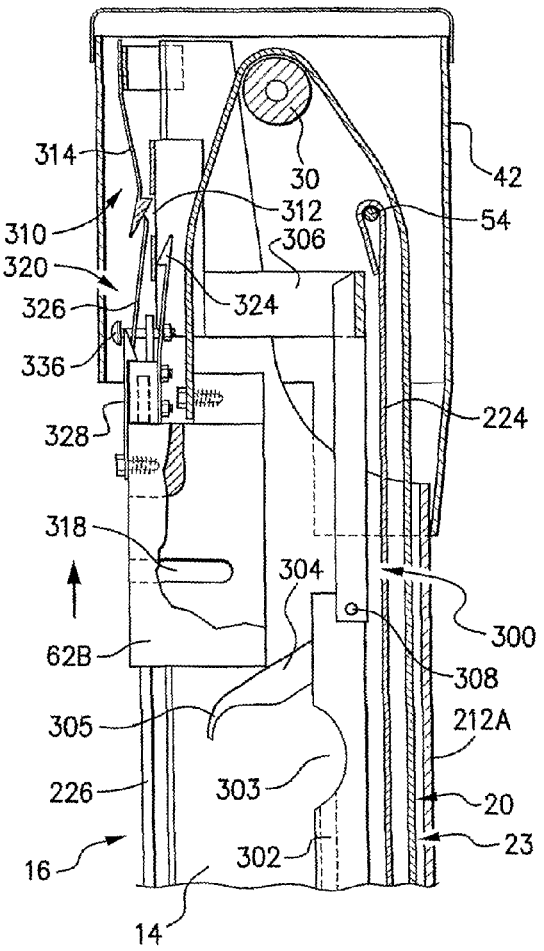
FIG. 26 is a similar view to FIG. 25, wherein the coupler is moving toward being fully engaged with the flag arm assembly.

The coupler 320 includes a coupler body 322, in which there is a bore 330. As perhaps better seen in FIGS. 20, 21 and 22, the yoke 226 includes means for engaging with the coupler 320 including a yoke protrusion 332 and a coupler retainer 334. The coupler retainer 334 may be formed from spring steel and includes a barb end. When the coupler 320 is attached to the yoke 226, the yoke protrusion 332 slides into the coupler bore 330 and the coupler retainer 334 flexes outwardly until the coupler 320 slides to the bottom of the yoke protrusion 332, wherein the coupler retainer 334 is biased to flex back into a position such that the barb on the coupler retainer acts to retain the coupler body 322, so that the coupler 320 is engaged with the yoke 226. FIGS. 25 and 26 show, perhaps more clearly, the coupler 320 engaged with the yoke 226.

Another step in preparing the yoke 226 for the flag lowering procedure is to remove the flag arm engagement roller 316 from the roller slot 318.

When the coupler 320 has been attached to the yoke 226 and the flag arm engagement roller 316 has been removed from the roller slot 318, the operator 400 causes the shutter 20 to be retracted which raises the yoke 226 toward the upper part of the device 10.

The coupler also includes a flag arm carriage retainer 324 which is formed from flexible spring steel with a barb at one end. Further, the coupler 320 includes a disengagement arm 326 for disengaging the flag arm carriage lock mechanism 310.

FIG. 24 shows the yoke 226 at the top end of the device 10. In this position, the coupler 320, which is attached to the yoke 226, engages with the flag arm carriage lock mechanism 310. As can be seen in FIG. 24, the flag arm engagement roller 316, having been removed from the yoke allows the yoke to move past the flag arm lever hook 305 without engaging it, which would otherwise cause the flag arm to move into a substantially horizontal position. Accordingly, the flag arm 302 remains in a substantially vertical position.

Figure 27:
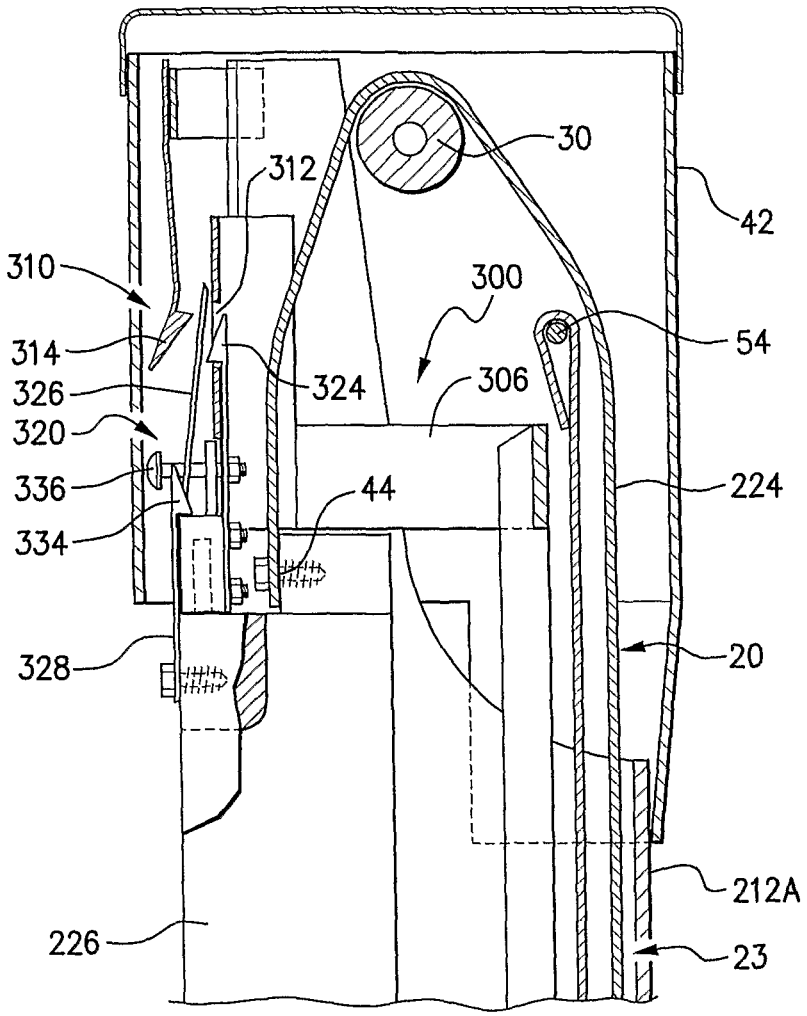
FIG. 27 is a similar view to FIG. 26, wherein the coupler is fully engaged with the flag arm assembly.

FIGS. 25 and 26, perhaps more clearly, show the yoke 226 with the attached coupler 320 moving toward and engaging with the flag arm carriage lock mechanism 310. As can be seen in FIG. 26, the disengagement arm 326 moves the locking arm 314 from the lock mechanism aperture 312. Further, the flag arm carriage retainer 324 flexes outwardly and -moves toward the lock mechanism 312. In FIG. 27, the yoke 226, along with the attached coupler 320, is abutting the flag arm carriage 306. In this position, the disengagement arm 326 has fully disengaged the locking arm 314 and the retainer 324 is engaged with the lock mechanism aperture. As such, the yoke 226 is coupled to the flag arm assembly 300 via the coupler 320.

In FIG. 28, the yoke 226, coupled with the flag arm assembly 300 via the coupler 320, is lowered toward the access aperture 344. In this way, the flag arm assembly 300 including the flag arm carriage 306, the flag arm 302, along with the flag 18 attached to the flag arm are able to be lowered.

Accordingly, as shown in FIG. 29, the "original" flag 18A can be detached from the flag arm 302 by unhooking the upper flag eyelet 356 from the flag arm hook 340 and unhooking the lower flag eyelet 354 from the halyard 232. The original flag 18A may be replaced with a new or different flag 18B.

Other steps in the procedure before raising the new or different flag 18B include removing the coupler 320, so that the yoke 226 and the flag arm assembly 300 are no longer coupled, and re-inserting the flag arm engagement roller 316 into the roller slot 318.

The coupler 320 includes a retainer disengagement button 336, which disengages the retainer 324 from the lock mechanism aperture 312. The disengagement button 336, when pushed in direction toward the coupler 320, moves a shaft of the button through an aperture in the disengagement arm 326 and an aperture in a coupler protrusion 338, which protrudes from the coupler body 322. The shaft of the button 336 is fixed to the retainer 324 and pressing the button 336 causes the retainer 324 to flex outwardly so as to disengage from the lock mechanism aperture 312.

After the coupler 320 has been disengaged from the flag arm assembly 300, the flag arm assembly 300 may be manually pushed upwardly as shown in FIG. 30 by the dashed line representation of the flag arm lever 304A. The manual upward movement of the flag arm assembly 300 continues until the flag arm lever 304 moves upwardly past the roller slot 318, such that the flag arm engagement roller 316 can be inserted into the slot 318.

Further, the coupler 320 can be removed from the yoke 226 by flexing the coupler retainer 334 on the yoke outwardly and, sliding the coupler 320 off the 25 protrusion 332.

When the coupler 320 has been removed, the flag arm engagement roller 316 has been re-inserted into the roller slot 318 and the flag has been replaced or substituted, the shutter actuator 22 can be operated to move the shutter 20 and the yoke 226 toward an upper position of the device 16. Moving the yoke 226 upwardly also causes the flag arm assembly 300 to move upwardly as the flag arm engagement roller forces against the flag arm lever hook 305 and the flag arm lever 304. When the flag arm assembly 300 moves toward the uppermost position in the device 10 the flag arm carriage causes the locking arm 314 to move outwardly until the barb of the locking arm 314 is located over the lock mechanism aperture 312 and the locking arm 314 move toward the flag arm carriage 306 so that the barb of the locking arm 314 engages into the lock mechanism aperture 312. In this way, the flag arm assembly is again retained at the uppermost position in the device 10. Furthermore, the yoke 226 can be raised and lowered whilst the flag arm assembly 300 remains in place at the uppermost position in device 10.

The access aperture 344, which is situated in the lower section 212B of the flag pole 212 may be located in a position which is accessible to the operator 400 while standing at ground level, where the bottom of the flag pole 12 is also at ground level. Alternatively, the access aperture 344 can be located at a position which is substantially inaccessible unless, for example, a ladder is used.

Furthermore, the access aperture 344 may include an access aperture cover 346, which can be open and closed with a cover latch 348. A further option is to have a lockable cover latch 348, so as to prevent unauthorized access to the access aperture 344.

Figure 31:
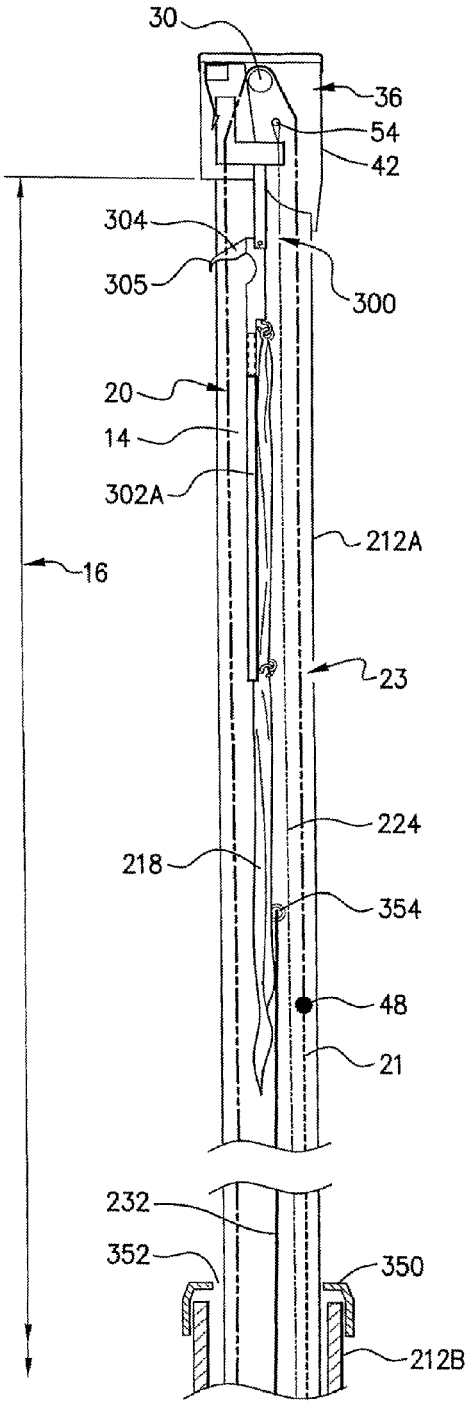
FIG. 31 is a similar view to FIG. 19, which is a detailed view of an upper section of the device configured to display a banner; and, FIG. 32 is a longitudinal cross-sectional detailed view of a lower section of the device, wherein the device is configured to display a banner and wherein the yoke, coupler and flag arm assembly are in a lowered position, substantially adjacent the access aperture, for removal and replacement of the banner.

FIG. 31 shows a detailed view of an upper section of the device 10, which is configured to display a banner 218. In this embodiment, the flag arm 302A is longer than in the embodiment shown in, for example, FIG. 16. In FIG. 31, the shutter 20 is deployed, the yoke 226 (not shown) has been moved to a lower part of the aperture 16, the flag arm engagement roller 316 (also not shown) is disengaged from the flag arm lever 304 and flag arm lever hook 305, such that the flag arm 302A is in a substantially vertical position.

Although parts of the flag arm assembly 300 (namely, a part of the flag arm lever 304, including the flag arm lever hook 305) are shown protruding outwardly beyond the shutter 20, it will be appreciated that this is merely a convenience to illustrate those parts in the figure. In this regard, all components of the flag arm assembly 300 may be behind the shutter 20 when it is deployed. Further, all parts of the flag arm assembly 300, when the flag arm 302, 302A is in a substantially vertical position, may be configured such that they do not protrude outwardly from the aperture 16, but remain substantially within the storage space 14.

Figure 32:
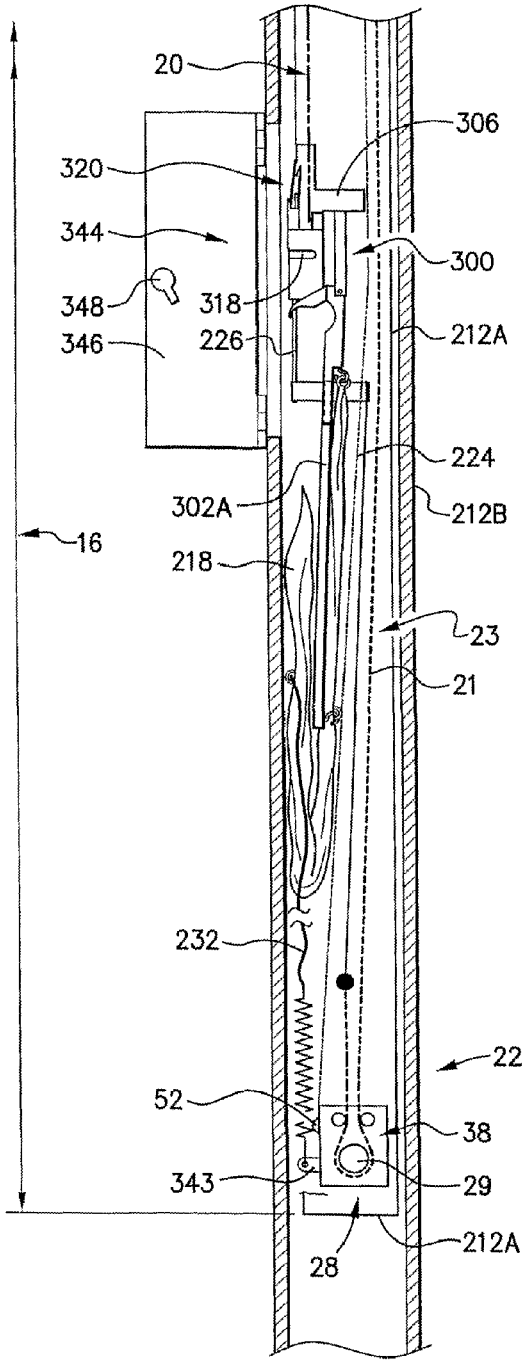

FIG. 32 shows the banner 218 when it is lowered. The yoke 226 is coupled to the flag arm assembly 300 via the coupler 320, such that the flag arm assembly 300 has been lowered to be substantially adjacent the access aperture 344. In this way, an operator 400 can access the banner 218 and remove it from the flag arm 302A.

In another embodiment, when the device 10, includes a flag arm 302 or 302A, it is possible to use a halyard 32 as shown in FIGS. 1 to 15, which is a halyard that forms a loop. In such an embodiment, the flag arm 302 or 302A may include an eyelet instead of a hook 340. The halyard 32 can be threaded through the eyelet and then the loop of the halyard 32 may be configured to pass through the inside of the flag pole 12 and a lower part of the halyard loop may be accessible through the access aperture 344. In this way, the halyard 32 may be operated to move the flag 18 to be in a half-mass position.

Moreover, it will be understood that various optional embodiments which can be applied to FIGS. 1 to 15 may also be applied to embodiments shown in FIGS. 16 to 32. Such option includes a motor for operating the drive mechanism 28, a control 96 for controlling the motor 90, a wind sensor 98, a precipitation sensor 106, a swivel 102 and/or a wind vane 100.

The invention is susceptible to variations, modifications and/or additions other than those specifically described, and it is to be understood that the invention includes all such variations, modifications and/or additions which fall within the scope of the following claims.

The claims defining the invention are as follows:

1. A device for protecting a flag when located in a storage space, wherein the storage space is located in an at least partially hollow flag pole, and wherein the storage space has an aperture formed through the flag pole, such that, when the aperture is uncovered, the flag is able to be displayed, the device including:

a retractable shutter for substantially covering the aperture, the retractable shutter including a shutter actuator for deploying and retracting the shutter, wherein the storage space is located substantially adjacent a position where the flag is displayed.

2. The device defined in claim 1, further including a divider, disposed rearwardly of the storage space with respect to the position where the flag is displayed, for substantially preventing contact between the flag, when in the storage space, and a part of the retractable shutter which is disposed rearwardly of the divider with respect to the storage space.

3. The device defined in claim 2, wherein the shutter and divider are formed from a flexible material, which is able to substantially protect the flag from damage which may be caused by environmental conditions.

4. The device defined in claim 1, wherein the retractable shutter further includes a yoke, disposed at a first end of the retractable shutter, for facilitating gathering of the flag in to the storage space when the retractable shutter is deployed.

5. The device defined in claim 1, wherein the shutter actuator includes a drive belt, which engages with a drive roller for moving the drive belt.

6. The device defined in claim 5, wherein the first end of the retractable shutter is connected to a first end of the yoke, a first end of the drive belt is connected to a second end of the yoke, and a second end of the retractable shutter is connected with a second end of the drive belt so as to form a loop, such that, when the drive belt is moved in a first direction, the retractable shutter is caused to be deployed, and such that, when the drive belt of the shutter actuator is moved in a second direction, the retractable shutter is caused to retract.

7. The device defined in claim 6, further including a drive mechanism for operating the shutter actuator to move in the first and the second directions, wherein the drive mechanism includes the drive roller disposed at a first end of the loop, and a second roller disposed at a second end of the loop, and wherein, when the device is located in a substantially vertically disposed flag pole, the drive roller is located at or near a lower end of, or below the storage space, and the second roller is located at or near an upper end of, or above the storage space.

8. The device defined in claim 7, further including a first mounting block for mounting the drive mechanism and a second mounting block for mounting the second roller, wherein, when the device is located in a substantially vertically disposed flag pole, the first mounting block is located at or toward and within a lower part of the flag pole, such that the drive mechanism is accessible to an operator, and the second mounting block is located at or toward and within a top part of the flag pole, and wherein the first mounting block includes a guide for guiding the drive belt.

9. The device defined in claim 8, wherein, when the device is located in a substantially vertically disposed flag pole, an upper end of the divider is connected to the second mounting block and a lower end of the divider is connected to the first mounting block.

10. The device defined in claim 6, wherein the yoke includes a cradle arm disposed at the second end of the yoke, and wherein the drive belt is connected to a portion of the yoke cradle arm which is disposed rearwardly of the divider with respect to the yoke, and wherein the yoke is configured such that the yoke cradle arm is substantially "U" shaped in cross-section and, and wherein each side of the cradle arm is connected, respectively, to a side of the yoke, and wherein the cradle arm is adapted so that the divider may be disposed between the sides of the cradle arm, and wherein, when the shutter is retracted to uncover the aperture, the cradle arm causes the divider to move forwardly into a first position toward the aperture.

11. The device defined in claim 5, wherein the drive belt is located rearwardly of the divider.

12. The device defined in claim 1, wherein the flag is mounted on a halyard for raising and lowering the flag.

13. The device defined in claim 12, wherein the halyard is mounted on the first mounting block via a spring.

14. The device defined in claim 1, wherein the flag pole has a longitudinal axis which is angled between 0 and 90 degrees with respect to a vertical plane.

15. The device defined in claim 1, further including a flag arm assembly for unfurling and displaying the flag and for storing the flag in the storage space, wherein the flag arm assembly includes a flag arm carriage for moving the flag arm assembly up and down the aperture, and a flag arm, connected to the flag arm carriage by a rotating mount, the flag arm including means for attaching the flag.

16. The device defined in claim 15, wherein the flag arm is adapted to move between a substantially perpendicular position with respect to the flag pole for displaying the flag and a substantially parallel position with respect to the flag pole for storing the flag in the storage space.

17. The device defined in claim 16, wherein the yoke includes a flag arm engagement roller such that, when the yoke moves toward the flag arm assembly, the flag arm is caused to move toward the substantially perpendicular position, and such that, when the yoke moves away from the flag arm assembly, the flag arm is able to move toward the substantially parallel position.

18. The device defined in claim 15, wherein the flag arm carriage includes a lock mechanism, when engaged, for retaining the flag arm assembly at or near an upper part of the device, and wherein the yoke is adapted to connect to and disconnect from the flag arm assembly such that, when the yoke is moved up or down the aperture, the flag arm assembly is also, respectively, moved up and down the aperture.

19. The device defined in claim 18, further including a detachable coupler configured to attach to and detach from the yoke and attach to and detach from the flag arm assembly, wherein the coupler is adapted to connect the yoke to the flag arm carriage, and wherein the coupler is adapted to disengage the flag arm carriage lock mechanism.

* * * * *